US010504396B2

(12) United States Patent
Jinta et al.

(10) Patent No.: US 10,504,396 B2
(45) **Date of Patent: *Dec. 10, 2019**

(54) DISPLAY DEVICE AND ELECTRONIC APPARATUS

(71) Applicant: Sony Corporation, Tokyo (JP)

(72) Inventors: Seiichiro Jinta, Kanagawa (JP); Akira Yumoto, Kanagawa (JP); Takahiro Seki, Tokyo (JP)

(73) Assignee: Sony Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/030,195

(22) Filed: Jul. 9, 2018

(65) Prior Publication Data

US 2019/0012946 A1 Jan. 10, 2019

Related U.S. Application Data

(63) Continuation of application No. 13/938,329, filed on Jul. 10, 2013, now Pat. No. 10,043,431.

(30) Foreign Application Priority Data

Jul. 31, 2012 (JP) ..... 2012-170489

(51) Int. Cl.

| | |
|---|---|
| ***G09G 3/20*** | (2006.01) |
| ***G09G 3/3266*** | (2016.01) |
| ***G09G 3/32*** | (2016.01) |
| ***G09G 3/3233*** | (2016.01) |

(52) U.S. Cl.

CPC ..... *G09G 3/20* (2013.01); *G09G 3/3233* (2013.01); *G09G 3/3266* (2013.01); *G09G 2300/0426* (2013.01); *G09G 2300/0819* (2013.01); *G09G 2300/0861* (2013.01); *G09G 2300/0866* (2013.01); *G09G 2320/0233* (2013.01); *G09G 2330/02* (2013.01)

(58) Field of Classification Search

CPC ..... G09G 3/3266; G09G 2310/0218; G09G 3/20; G09G 3/3274; G09G 3/3277; G09G 2300/0426

See application file for complete search history.

(56) References Cited

U.S. PATENT DOCUMENTS

| | | | | |
|---|---|---|---|---|
| 6,717,566 | B2 | 4/2004 | Wang | |
| 6,801,182 | B2 * | 10/2004 | Yang | G09G 3/3677 345/100 |
| 2002/0080108 | A1 | 6/2002 | Wang | |

(Continued)

FOREIGN PATENT DOCUMENTS

| | | | |
|---|---|---|---|
| JP | S58-127991 | A | 7/1983 |
| JP | 2002-311879 | A | 10/2002 |

(Continued)

*Primary Examiner* — Xuemei Zheng

(74) *Attorney, Agent, or Firm* — Michael Best & Friedrich LLP

(57) ABSTRACT

A display device includes: a display unit that includes a plurality of pixels and a plurality of scanning signal lines delivering scanning pulses to the plurality of pixels; and a scanning unit that includes a first switch provided in association with each of the plurality of scanning signal lines and selectively extracting the scanning pulse from one of a plurality of scanning pulse signals including the plurality of scanning pulses.

18 Claims, 28 Drawing Sheets

(56) References Cited

U.S. PATENT DOCUMENTS

| | | | |
|---|---|---|---|
| 2008/0111812 | A1 | 5/2008 | Shirasaki et al. |
| 2009/0251443 | A1 | 10/2009 | Jinta |
| 2011/0032284 | A1 | 2/2011 | Owaku |
| 2013/0021312 | A1 | 1/2013 | Kishi |

FOREIGN PATENT DOCUMENTS

| | | |
|---|---|---|
| JP | 2005-228459 | 8/2005 |
| JP | 2009-252269 | 10/2009 |
| JP | 2010-002796 | 1/2010 |
| JP | 2010-281993 | 12/2010 |
| WO | WO-2011/125361 A1 | 10/2011 |

* cited by examiner

FIG. 11

| n | $n \times \sqrt[n]{x_1 \times x_2 \times \cdots \times x_n}$ |
|---|---|
| 1 | 1,080.0 |
| 2 | 65.7 |
| 3 | 30.8 |
| 4 | 22.9 |
| 5 | 20.2 |
| 6 | 19.2 |
| 7 | 19.0 |
| 8 | 19.2 |
| 9 | 19.6 |
| 10 | 20.1 |
| 11 | 20.8 |
| 12 | 21.5 |

FIG. 12

| n | $x_1$ | $x_2$ | $x_3$ | $x_4$ | $\Sigma x_i$ |
|---|---|---|---|---|---|
| 1 | 1,080 | | | | 1,080 |
| 2 | 30 | 36 | | | 66 |
| 3 | 9 | 10 | 12 | | 31 |
| 4 | 5 | 6 | 6 | 6 | 23 |

DISPLAY DEVICE AND ELECTRONIC APPARATUS

CROSS REFERENCES TO RELATED APPLICATIONS

This application is a Continuation Application of patent application Ser. No. 13/938,329, filed Jul. 10, 2013, which claims priority to Japanese Patent Application No. 2012-170489 filed in the Japan Patent Office on Jul. 31, 2012, the entire contents of which being incorporated herein by reference.

BACKGROUND

The present disclosure relates to a display device including a current driving type display element, a driving circuit used in the display device, and an electronic apparatus including the display device.

In recent years, in a field of display devices performing image display, display devices (organic EL display devices) using, as a light-emitting element, a current driving type optical element, such as an organic EL (Electro Luminescence) element, in which light emission luminance varies according to the value of a flowing current have been developed and commercialized. Since the organic EL element is a self-luminous element unlike a liquid crystal element or the like, a light source (backlight) is not necessary. Therefore, the organic EL display device has characteristics such as high image visibility, low power consumption, and high response speed of an element, compared to a liquid crystal display device in which a light source is necessary.

In such a display device, various circuits that drive a display unit are formed in the periphery of the display unit in which pixels are arrayed in a matrix form. Specifically, a source driver circuit that supplies a pixel signal to a pixel, a write scanning circuit that selects a pixel line supplying the pixel signal, a power supply scanning circuit that supplies power to a pixel, and the like are formed in the periphery of the display unit (for example, see Japanese Unexamined Patent Application Publication No. 2010-2796, Japanese Unexamined Patent Application Publication No. 2010-281993, Japanese Unexamined Patent Application Publication No. 2009-252269, and Japanese Unexamined Patent Application Publication No. 2005-228459).

SUMMARY

Mainly, from the viewpoint of design, a so-called frame region in the periphery of a display unit is preferably narrowed in a display device. Therefore, circuits formed in the periphery of the display unit are expected to have a simple configuration.

It is desirable to provide a display device, a driving circuit, and an electronic apparatus in which a frame region can be narrowed.

According to an embodiment of the present disclosure, there is provided a display device including a display unit and a scanning unit. The display unit includes a plurality of pixels and a plurality of scanning signal lines delivering scanning pulses to the plurality of pixels. The scanning unit includes a first switch provided in association with each of the plurality of scanning signal lines and selectively extracting the scanning pulse from one of a plurality of scanning pulse signals including the plurality of scanning pulses.

According to another embodiment of the present disclosure, there is provided a driving circuit including a first switch that is provided in association with each of a plurality of scanning signal lines delivering scanning pulses to a plurality of pixels and selectively extracts the scanning pulse from one of a plurality of scanning pulse signals including the plurality of scanning pulses.

According to still another embodiment of the present disclosure, there is provided an electronic apparatus including the above-described display device. Examples of the electronic apparatus include a television apparatus, a digital camera, a personal computer, a video camera, and a portable terminal apparatus such as a portable telephone.

In the display device, the driving circuit, and the electronic apparatus according to the embodiments of the present disclosure, the scanning pulses are supplied to the plurality of pixels via the scanning signal lines and the display scanning is performed. The scanning pulse is used to turn on the first switch, and thus is selectively extracted from one of the plurality of scanning pulse signals and is supplied to the scanning signal line.

The display device, the driving circuit, and the electronic apparatus according to the embodiments of the present disclosure are configured to include the first switch selectively extracting the scanning pulse from one of the plurality of scanning pulse signals. Accordingly, the frame region can be narrowed.

BRIEF DESCRIPTION OF THE DRAWINGS

FIG. 11 is a table illustrating a sum number of wirings;

FIG. 12 is a table illustrating a wiring configuration;

DETAILED DESCRIPTION OF EMBODIMENTS

Hereinafter, embodiments of the present disclosure will be described in detail with reference to the drawings. The description will be made in the following order.

1. First Embodiment
2. Second Embodiment
3. Application Examples

1. First Embodiment

Configuration Example

Figure 1:
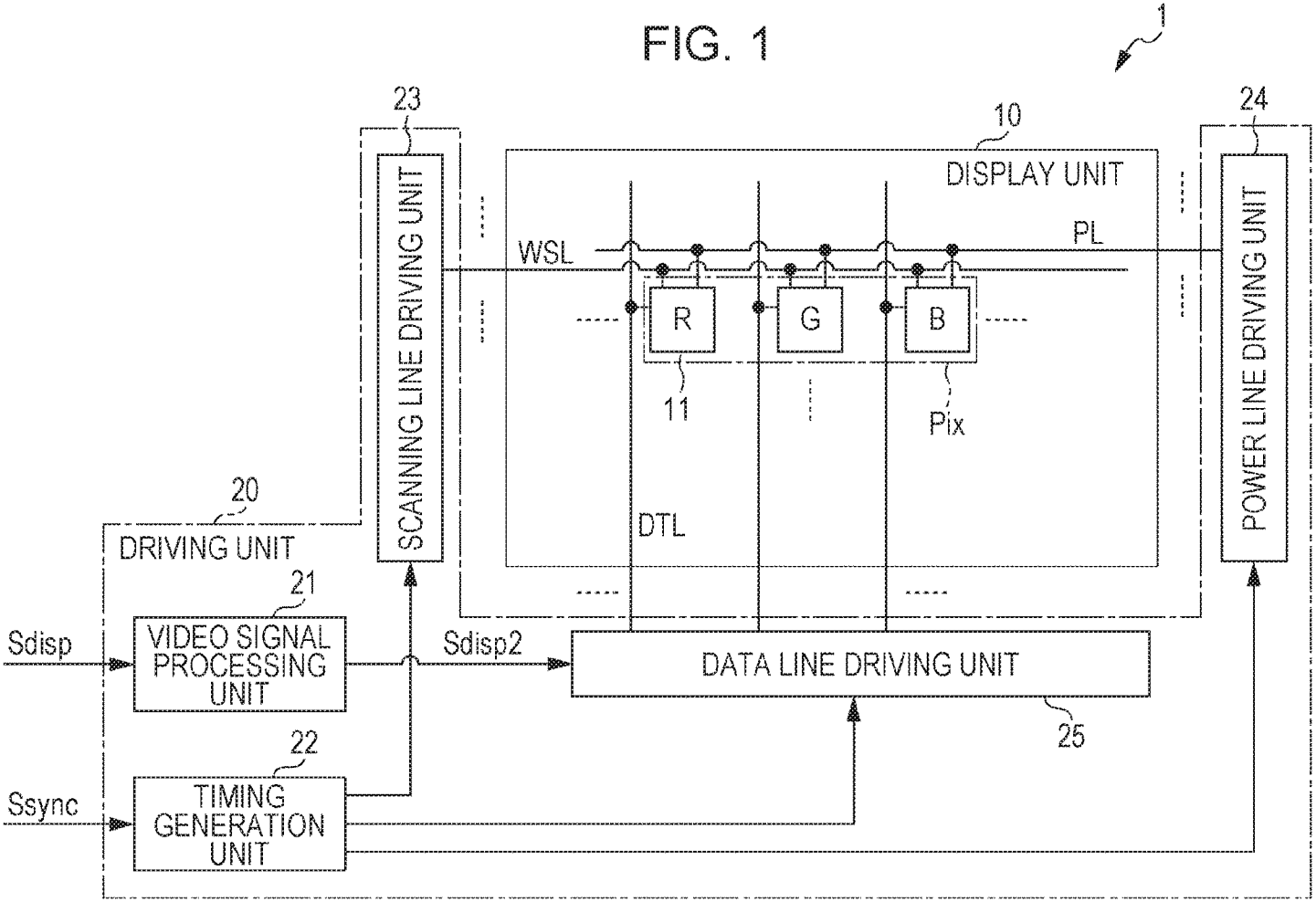
FIG. 1 is a block diagram illustrating one configuration example of a display device according to a first embodiment of the present disclosure.

FIG. 1 is a diagram illustrating one configuration example of a display device according to a first embodiment. A display device 1 is an active matrix type display device using an organic EL element. A driving circuit of embodiments of the present disclosure is realized according to this embodiment and the description thereof will be made. The display device 1 includes a display unit 10 and a driving unit 20.

In the display unit 10, a plurality of pixels Pix are arrayed in a matrix form. In this example, the display unit 10 is a high-definition (so-called FHD) panel with 1920 pixels× 1080 pixels. Each pixel Pix includes red, green, and blue sub-pixels 11. The display unit 10 includes a plurality of scanning lines WSL and a plurality of power lines PL extending in the row direction (horizontal direction) and a plurality of data lines DTL extending in the column direction (vertical direction). One end of each of the scanning lines WSL, the power lines PL, and the data lines DTL is connected to the driving unit 20. Each of the above-described sub-pixels 11 is disposed at an intersection of the scanning line WSL and the data line DTL.

Figure 2:
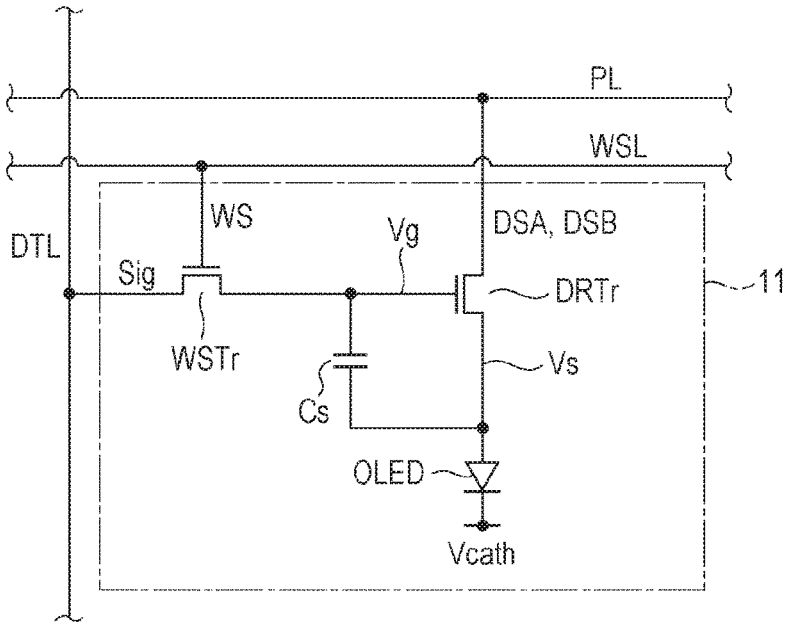
FIG. 2 is a circuit diagram illustrating one configuration example of a sub-pixel illustrated in FIG. 1.

FIG. 2 is a diagram illustrating an example of the circuit configuration of the sub-pixel 11. The sub-pixel 11 includes a write transistor WSTr, a driving transistor DRTr, an organic EL element OLED, and a capacitative element Cs. That is, in this example, the sub-pixel 11 has a so-called "2Tr1C" configuration realized by two transistors (the write transistor WSTr and the driving transistor DRTr) and one capacitative element Cs.

The write transistor WSTr and the driving transistor DRTr are configured to include, for example, an N-channel MOS (Metal Oxide Semiconductor) type TFT (Thin Film Transistor). The gate of the write transistor WSTr is connected to the scanning line WSL, the source thereof is connected to the data line DTL, and the drain thereof is connected to the gate of the driving transistor DRTr and one end of the capacitative element Cs. The gate of the driving transistor DRTr is connected to the drain of the write transistor WSTr and the one end of the capacitative element Cs, the drain thereof is connected to the power line PL, and the source thereof is connected to the other end of the capacitative element Cs and an anode of the organic EL element OLED. The kind of TFT is not particularly limited. For example, an inverse stagger configuration (so-called bottom gate type) may be used or a stagger configuration (so-called top gate type) may be used.

The one end of the capacitative element Cs is connected to the gate of the driving transistor DRTr and the like and the other end thereof is connected to the source of the driving transistor DRTr and the like. The organic EL element OLED is a light-emitting element that emits light of a color (read, green, or blue) corresponding to each sub-pixel 11. The anode of the organic EL element OLED is connected to the source of the driving transistor DRTr and the other end of the capacitative element Cs. The driving unit 20 supplies a cathode voltage Vcath to the cathode of the organic EL element OLED.

The driving unit 20 drives the display unit 10 based on a video signal Sdisp and a synchronization signal Ssync supplied from the outside. The driving unit 20 includes a video signal processing unit 21, a timing generation unit 22, a scanning line driving unit 23, a power line driving unit 24, and a data line driving unit 25, as illustrated in FIG. 1.

Figure 3:
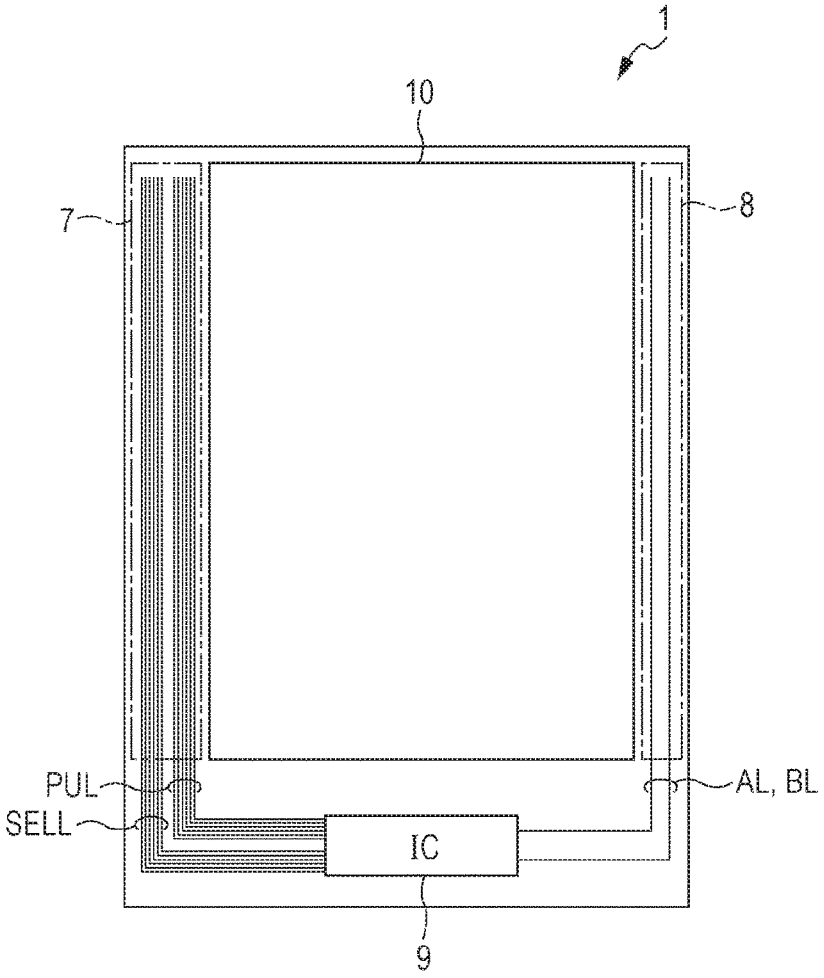
FIG. 3 is a diagram illustrating arrangement of each block illustrated in FIG. 1.

FIG. 3 is a diagram illustrating an example of the arrangement of each block in the display device 1. In this example, the video signal processing unit 21, the timing generation unit 22, and the data line driving unit 25 are formed in an IC (Integrated Circuit) 9. The scanning line driving unit 23 is formed in a left-side region 7 of the display unit 10 and the IC 9. Pulse signal lines PUL, selection signal lines SELL, and a plurality of transistors STr to be described below are disposed in the region 7. The power line driving unit 24 is formed in a right-side region 8 of the display unit 10 and the IC 9. Power signal lines AL and BL to be described below are disposed in the region 8. In the display device 1, as will be described below, the regions 7 and 8 are narrowed and a so-called frame region can thus be narrowed by simplifying the configurations of the scanning line driving unit 23 and the power line driving unit 24.

The video signal processing unit 21 performs predetermined signal processing on the video signal Sdisp supplied from the outside to generate a video signal Sdisp2. Examples of the predetermined signal processing include gamma correction and overdrive correction.

The timing generation unit 22 is a circuit that supplies a control signal to each of the scanning line driving unit 23, the power line driving unit 24, and the data line driving unit 25 based on the synchronization signal Ssync supplied from the outside and performs control such that these units are mutually synchronized and operate.

The scanning line driving unit 23 sequentially selects the sub-pixels 11 of each row by sequentially applying a scanning signal WS to the plurality of scanning lines WSL according to the control signal supplied from the timing generation unit 22.

Figure 4:
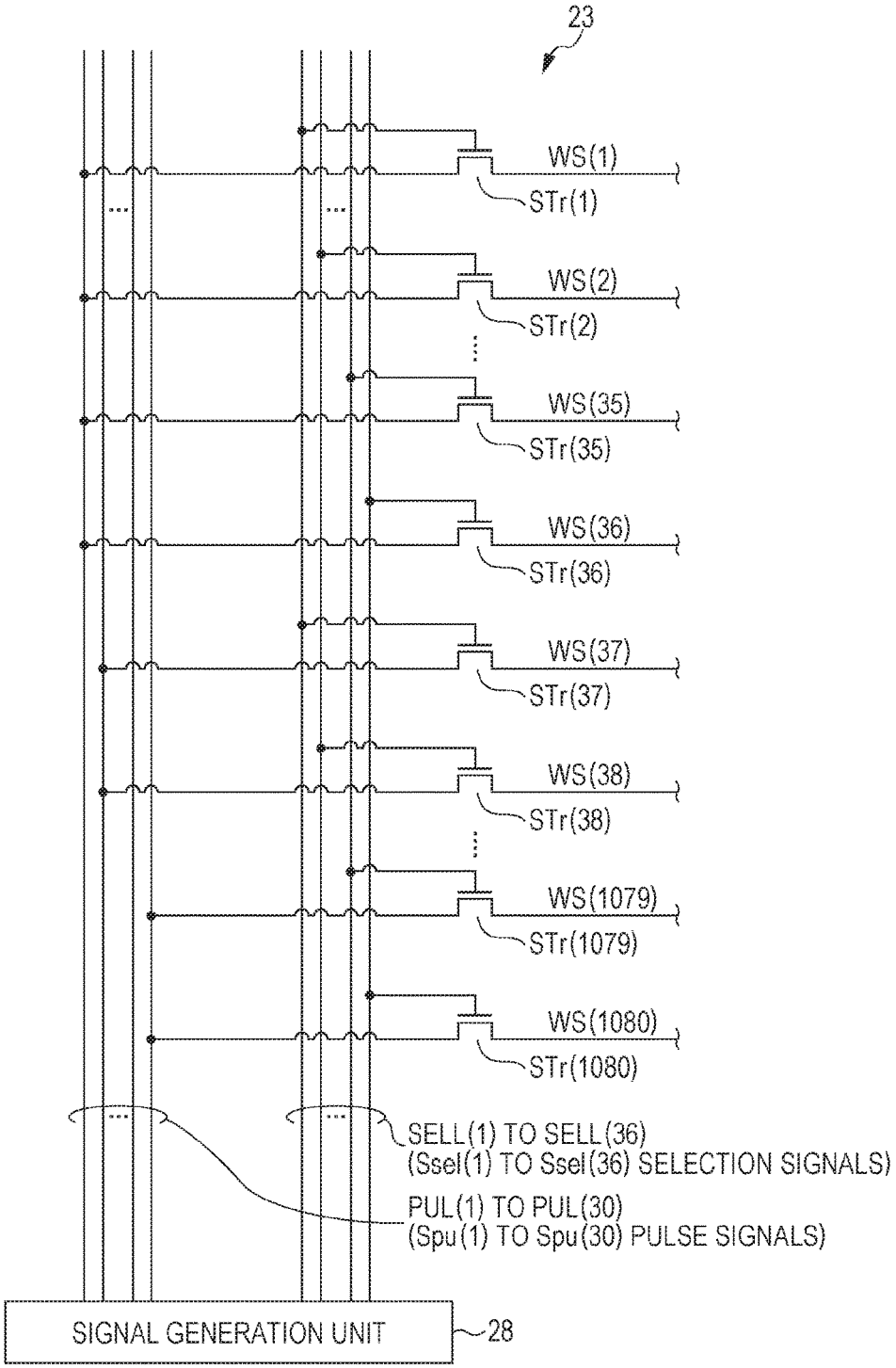
FIG. 4 is a circuit diagram illustrating one configuration example of a scanning line driving unit illustrated in FIG. 1.

FIG. 4 is a diagram illustrating one configuration example of the scanning line driving unit 23. The scanning line driving unit 23 includes a signal generation unit 28 and the plurality of transistors STr.

The signal generation unit 28 generates 30 pulse signals Spu (pulse signals Spu(1) to Spu(30)) based on the control signal (not illustrated) supplied from the timing generation unit 22 to apply the pulse signals Spu to pulse signal lines PUL (pulse signal lines PUL(1) to PUL(30)) and generates 36 selection signals Ssel (selection signals Ssel(1) to Ssel(36)) to apply the selection signals Ssel to selection signal lines SELL (selection signal lines SELL(1) to SELL(36)). As will be described below, the pulse signals Spu(1) to Spu(30) include pulses SP1 shown in the scanning signals WS (scanning signals WS(1) to WS(1080)). The selection signals Ssel(1) to Ssel(36) are used to control ON and OFF of the plurality of transistors STr. In this example, the signal generation unit 28 is formed in the IC 9.

The transistors STr (transistors STr(1) to STr(1080)) are provided to correspond to the scanning lines WSL of the display unit 10, respectively. In this example, the transistors STr(1) to STr(1080) are configured to include N channel MOS type TFTs and are formed in the region 7 (see FIG. 3). In the transistors STr(1) to STr(1080), the sources are connected to any one of the pulse signals PUL(1) to PUL(30), the gates are connected to any one of the selection signals SELL(1) to SELL(36), and the drains are connected to the corresponding scanning line WSL in the display unit 10. Specifically, for example, in the transistors STr(1) to STr(36), the sources are connected to the pulse signal line PUL(1) and the gates are connected to the selection signal lines SELL(1) to SELL(36), respectively. Likewise, for example, in the sources of the transistors STr(37) to STr(72), the sources are connected to the pulse signal line PUL(2) and the gates are connected to the selection signal lines SELL(1) to SELL(36), respectively.

In this configuration, the transistors STr(1) to STr(1080) are configured to select the pulses SP1 included in the pulse signals Spu(1) to Spu(36) based on the selection signals Ssel(1) to Ssel(36) and output the pulse signals SP1 as the scanning signals WS(1) to WS(1080).

The power line driving unit 24 controls a light emission operation and a light extinction operation of the sub-pixels 11 by applying power signals DSA and DSB to the plurality of power lines PL according to the control signal supplied from the timing generation unit 22.

Figure 5:
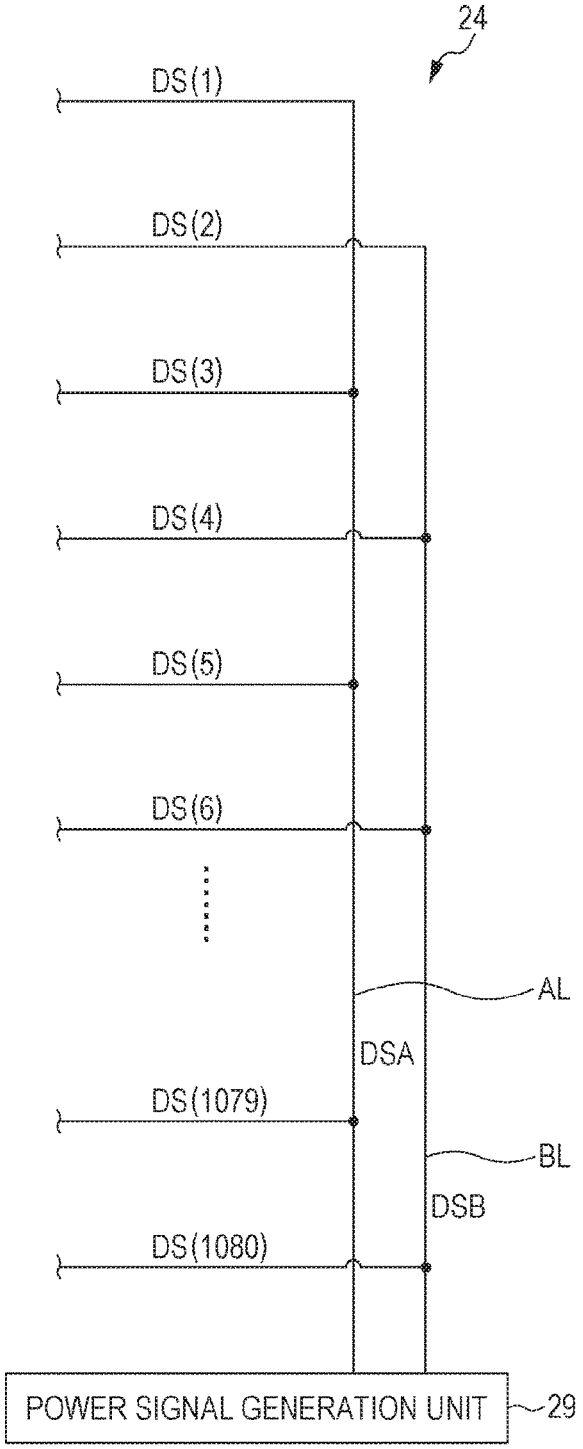
FIG. 5 is a circuit diagram illustrating one configuration example of a power line driving unit illustrated in FIG. 1.

FIG. 5 is a diagram illustrating one configuration example of the power line driving unit 24. The power line driving unit 24 includes a power signal generation unit 29. The power signal generation unit 29 generates the power signals DSA and DSB based on the control signal (not illustrated) supplied from the timing generation unit 22 and is formed in the IC 9. The power signals DSA and DSB transition between a voltage Vccp and a voltage Vini. As will be described below, the voltage Vini is a voltage used to initialize the sub-pixels 11 and the voltage Vccp is a voltage used to flow a current Ids to the driving transistors DRTr to cause the organic EL element OLED to emit light. In this example, the power signal generation unit 29 is configured to supply the power signal DSA to the power lines PL of odd rows (1, 3, 5, 7, . . . ) in the display unit 10 via the power signal line AL and supply the power signal DSB to the power lines PL of even rows (2, 4, 6, 8, . . . ) via the power signal line BL. As will be described below, the power signal generation unit 29 is configured to independently set a ratio (duty ratios) of a period of a high voltage level (voltage Vccp) to a period of low voltage level (voltage Vini) for each of the power signals DSA and DSB. Hereinafter, the power signal DS is assumed to be appropriately used as one of the power signals DSA and DSB.

The data line driving unit 25 generates a signal Sig including a pixel voltage Vsig used to give an instruction of a light emission luminance of each sub-pixel 11 according to the video signal Sdisp2 supplied from the video signal processing unit 21 and the control signal supplied from the timing generation unit 22, and then applies the signal Sig to each data line DTL.

In this configuration, as will be described below, the driving unit 20 performs correction (Vth correction and μ(mobility) correction) of suppressing an influence of element variation of the driving transistors DRTr on image quality and writes the pixel voltage Vsig on the sub-pixels 11 within one horizontal period. Thereafter, the organic EL elements OLED of the sub-pixels 11 are configured to emit light with luminance corresponding to the written pixel voltage Vsig.

Here, the scanning line WSL corresponds to one specific example of a "scanning signal line" according to an embodiment of the present disclosure. The scanning line driving unit 23 corresponds to one specific example of a "scanning unit" according to an embodiment of the present disclosure. The transistor STr corresponds to one specific example of a "first switch" according to an embodiment of the present disclosure. The pulse signals Spu(1) to Spu(30) correspond to one specific example of a "scanning pulse signal" according to an embodiment of the present disclosure.

Operation and Effect

Next, an operation and effect of the display device 1 according to this embodiment will be described.

Whole Operation Overview

First, a whole operation overview of the display device 1 will be described with reference to FIG. 1. The video signal processing unit 21 performs predetermined signal processing on the video signal Sdisp supplied from the outside to generate the video signal Sdisp2. The timing generation unit 22 supplies the control signal to each of the scanning line driving unit 23, the power line driving unit 24, and the data line driving unit 25 based on the synchronization signal Ssync supplied from the outside and performs control such that these units are mutually synchronized and operate. The scanning line driving unit 23 sequentially selects the sub-pixels 11 of each row by sequentially applying the scanning signal WS to the plurality of scanning lines WSL according to the control signal supplied from the timing generation unit 22. The power line driving unit 24 controls the light emission operation and the light extinction operation of the sub-pixels 11 by applying the power signals DSA and DSB to the plurality of power lines PL according to the control signal supplied from the timing generation unit 22. The data line driving unit 25 generates the signal Sig including the pixel voltage Vsig corresponding to the light emission luminance of each sub-pixel 11 according to the video signal Sdisp2 supplied from the video signal processing unit 21 and the control signal supplied from the timing generation unit 22 and applies the signal Sig to each data line DTL. The display unit 10 performs display based on the scanning signals WS, the power signals DS, and the signals Sig supplied from the driving unit 20.

Detailed Operation

Figure 6:
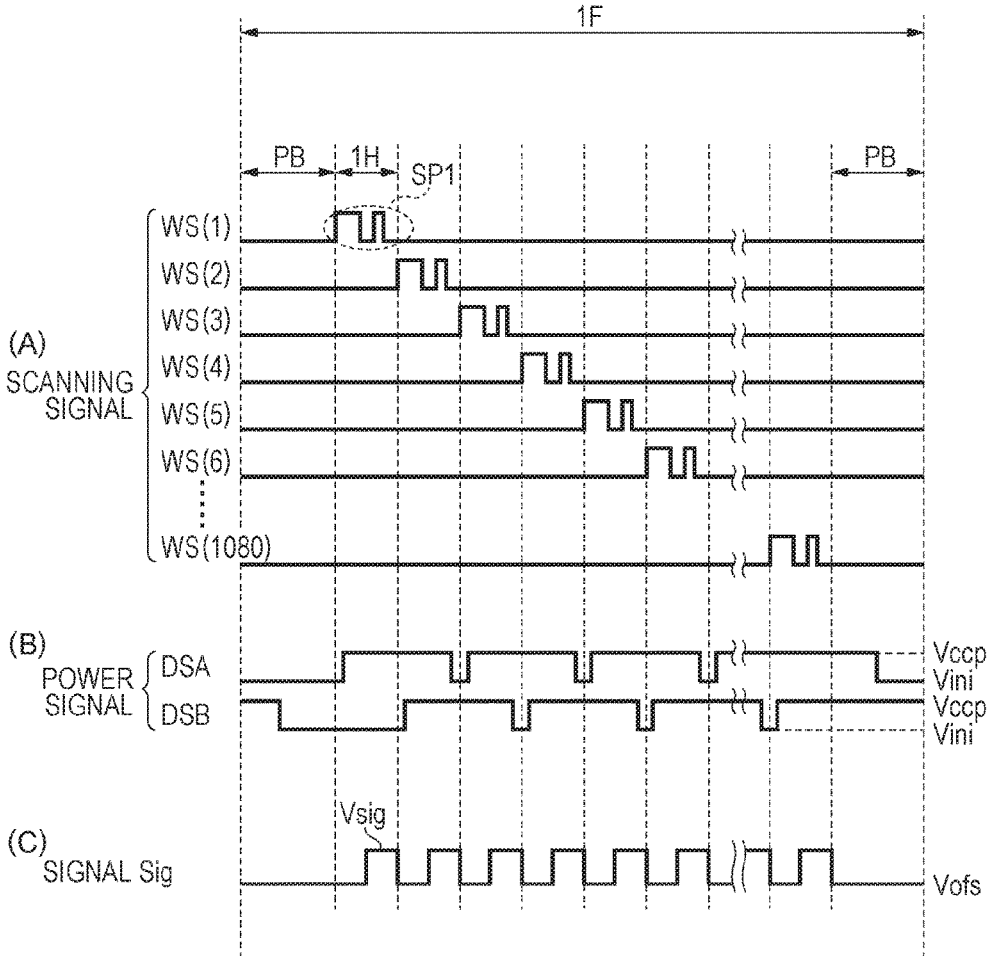
FIG. 6 is a timing waveform diagram illustrating one operation example of the display device illustrated in FIG. 1.

FIG. 6 is a diagram illustrating one operation example during one frame period (1F) of the display device 1. FIG. 6(A) illustrates the waveforms of the scanning signals WS, FIG. 6(B) illustrates the waveforms of the power signals DSA and DSB, and FIG. 6(C) illustrates the waveform of the signal Sig. The scanning line driving unit 23 sequentially supplies the pulse SP1 to each scanning line WSL for each horizontal period (1H) after an initially provided vertical blanking period PB during one frame period (1F) (see FIG. 6(A)). The power line driving unit 24 supplies the power signal DSA to the power lines PL of the odd rows and supplies the power signal DSB to the power lines PL of the even rows (see FIG. 6(B)). At this time, the power line driving unit 24 sets the power signal DSA to the voltage Vini during the first one horizontal period (1H) in which the pulse SP1 is shown in the scanning signals WS of the odd rows and sets the power signal DSB to the voltage Vini during the first one horizontal period (1H) in which the pulse SP1 is shown in the scanning signals WS of the even rows. The data line driving unit 25 sets the signal Sig to a voltage Vofs during the first half of each horizontal period (1H) and sets the signal Sig to the pixel voltage Vsig during the second half of each horizontal period (see FIG. 6(C)).

Figure 7:
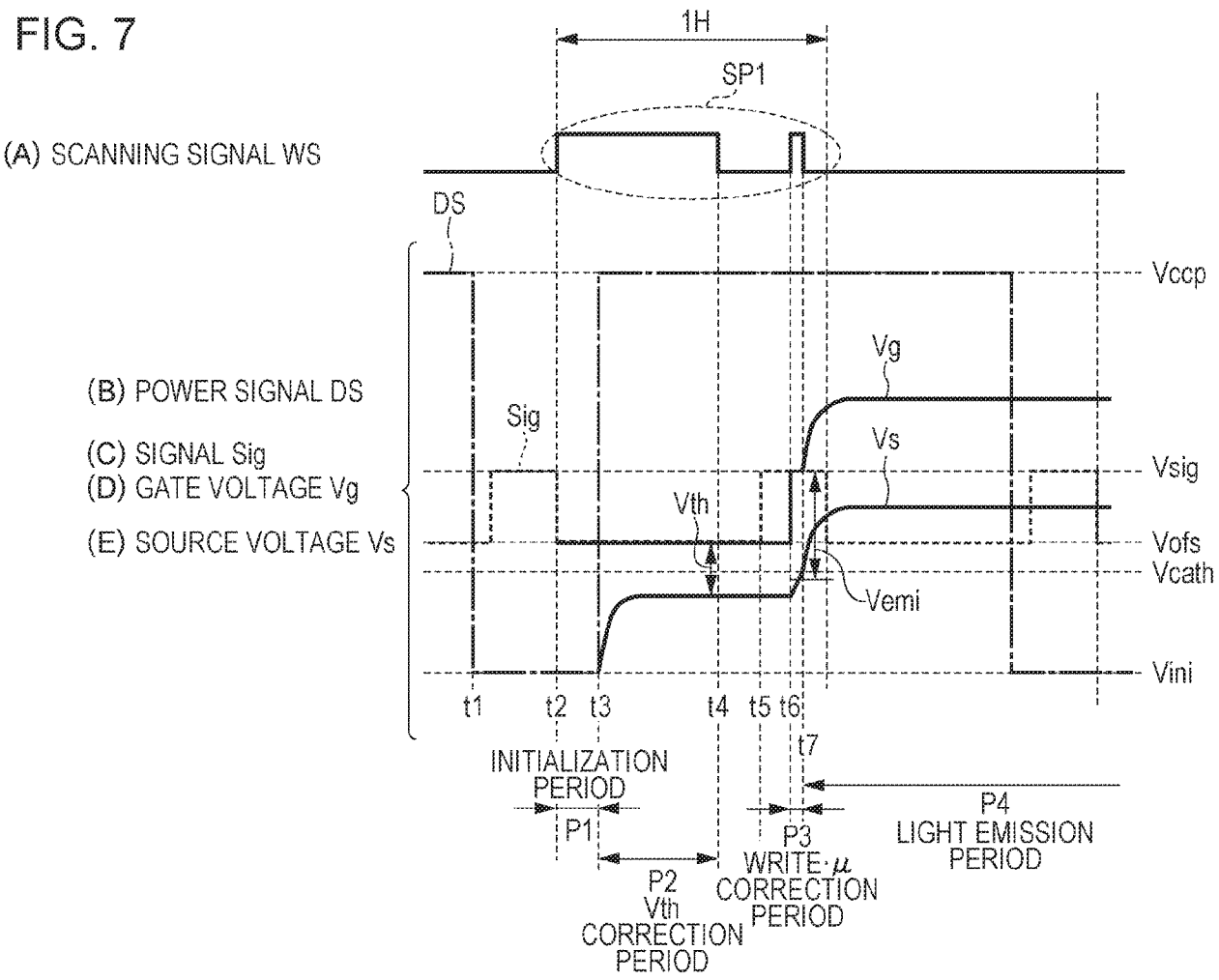
FIG. 7 is a timing waveform diagram illustrating one operation example of the sub-pixel illustrated in FIG. 1.

FIG. 7 is a diagram illustrating timings of a display operation in the display device 1. The drawings illustrate an operation example of the display driving on one sub-pixel 11 of interest. FIG. 7(A) illustrates the waveform of the scanning signal WS, FIG. 7(B) illustrates the waveform of the power signal DS, FIG. 7(C) illustrates the waveform of the signal Sig, FIG. 7(D) illustrates the waveform of a gate voltage Vg of the driving transistor DRTr, and FIG. 7(E) illustrates the waveform of a source voltage Vs of the driving transistor DRTr. In FIG. 7(B) to FIG. 7(E), the respective waveforms are illustrated using the same voltage axis. The power signal DS (see FIG. 7(B)) corresponds to the power signal DSA, when the sub-pixel 11 belongs to an odd row, and corresponds to the power signal DSB, when the sub-pixel 11 belongs to an even row.

The driving unit 20 initializes the sub-pixels 11 within one horizontal period (1H) (initialization period P1), performs the Vth correction of suppressing the influence of the element variation of the driving transistors DRTr on the image quality (Vth correction period P2), writes the pixel voltage Vsig on the sub-pixel 11, and performs the μ (mobility) correction different from the above-described Vth correction (write and μ correction period P3). Thereafter, the organic EL element OLED of the sub-pixel 11 emits light luminance corresponding to the written pixel voltage Vsig (light emission period P4). Hereinafter, the detailed description will be made.

First, the power line driving unit 24 changes the power signal DS from the voltage Vccp to the voltage Vini at a timing t1 before the initialization period P1 (see FIG. 7(B)). Thus, the driving transistor DRTr is turned on, and thus the source voltage Vs of the driving transistor DRTr is set to the voltage Vini (see FIG. 7(E)).

Next, the driving unit 20 initializes the sub-pixel 11 during a period (initialization period P1) of timings t2 and t3. Specifically, at the timing t2, the data line driving unit 25 sets the signal Sig to the voltage Vofs (see FIG. 7(C)) and the scanning line driving unit 23 changes the voltage of the scanning signal WS from a low level to a high level (see FIG. 7(A)). Thus, the write transistor WSTr is turned on, and thus the gate voltage Vg of the driving transistor DRTr is set to the voltage Vofs (see FIG. 7(D)). In this way, a voltage Vgs between the gate and the source of the driving transistor DRTr is set to a voltage (Vofs-Vini) greater than a threshold voltage Vth of the driving transistor DRTr, and thus the sub-pixel 11 is initialized.

Next, the driving unit 20 performs the Vth correction during a period (Vth correction period P2) of timings t3 and t4. Specifically, the power line driving unit 24 changes the power signal DS from the voltage Vini to the voltage Vccp at the timing t3 (see FIG. 7(B)). Thus, the driving transistor DRTr operates in a saturated region, the current Ids flows from the drain to the source, and thus the source voltage Vs increases (see FIG. 7(E)). At this time, since the source voltage Vs is less than the voltage Vcath of the cathode of the organic EL element OLED, the organic EL element OLED maintains an inverse bias state and no current thus flows in the organic EL element OLED. In this way, since the source voltage Vs increases and thus the voltage Vgs between the gate and the source decreases, the current Ids decreases. Through such a negative feedback operation, the current Ids is gradually converged to "0" (zero). In other words, the voltage Vgs between the gate and the source of the driving transistor DRTr is gradually converted so as to be identical with the threshold voltage Vth (Vgs=Vth) of the driving transistor DRTr.

Next, the scanning line driving unit 23 changes the voltage of the scanning signal WS from the high level to the low level at the timing t4 (see FIG. 7(A)). Thus, the write transistor WSTr is turned off. Then, the data line driving unit 25 sets the signal Sig to the pixel voltage Vsig at a timing t5 (see FIG. 7(C)).

Next, the driving unit 20 writes the pixel voltage Vsig on the sub-pixel 11 during a period (write and μ correction period P3) of timings t6 and t7 and performs the μ correction. Specifically, the scanning line driving unit 23 changes the voltage of the scanning signal WS from the low level to the high level at the timing t6 (see FIG. 7(A)). Thus, the write transistor WSTr is turned on, and thus the gate voltage Vg of the driving transistor DRTr increases from the voltage Vofs to the pixel voltage Vsig (see FIG. 7(D)). At this time, since the voltage Vgs between the gate and the source of the driving transistor DRTr is greater than the threshold voltage Vth (Vgs>Vth) and the current Ids flows from the drain to the source, the source voltage Vs of the driving transistor DRTr increases (see FIG. 7(E)). Through such as negative feedback operation, the influence of the element variation of the driving transistors DRTr is suppressed (μ correction) and the voltage Vgs between the gate and the source of the driving transistor DRTr is set to a voltage Vemi according to the pixel voltage Vsig.

Next, the driving unit 20 causes the sub-pixel 11 to emit light during a period (a light emission period P4) after the timing t7. Specifically, at the timing t7, the scanning line driving unit 23 changes the voltage of the scanning signal WS from the high level to the low level (see FIG. 7(A)). Thus, since the write transistor WSTr is turned off and the gate of the driving transistor DRTr is floated, an inter-terminal voltage of the capacitative element Cs, that is, a voltage Vgs (=Vemi) between the gate and the source of the driving transistor DRTr is maintained subsequently. Then, the current Ids flows to the driving transistor DRTr, and thus the source voltage Vs of the driving transistor DRTr increases (see FIG. 7(E)). Accordingly, the gate voltage Vg of the driving transistor DRTr also increases (see FIG. 7(D)). Then, when the source voltage Vs of the driving transistor DRTr is greater than a sum (Vel+Vcath) of a threshold voltage Vel and the voltage Vcath of the organic EL element OLED, a current flow between the anode and the cathode of the organic EL element OLED and the organic EL element OLED thus emits the light. That is, the source voltage Vs increases by a degree corresponding to the element variation of the organic EL element OLED and the organic EL element OLED emits the light.

Scanning Line Driving Unit 23

Next, a detailed operation of the scanning line driving unit 23 will be described. In the following example, the description will be made giving an example in which the number of scanning lines WSL is assumed to be 8 and a scanning line driving unit 33 generates 8 scanning signals WS(1) to WS(8) to facilitate the description.

Figure 8:
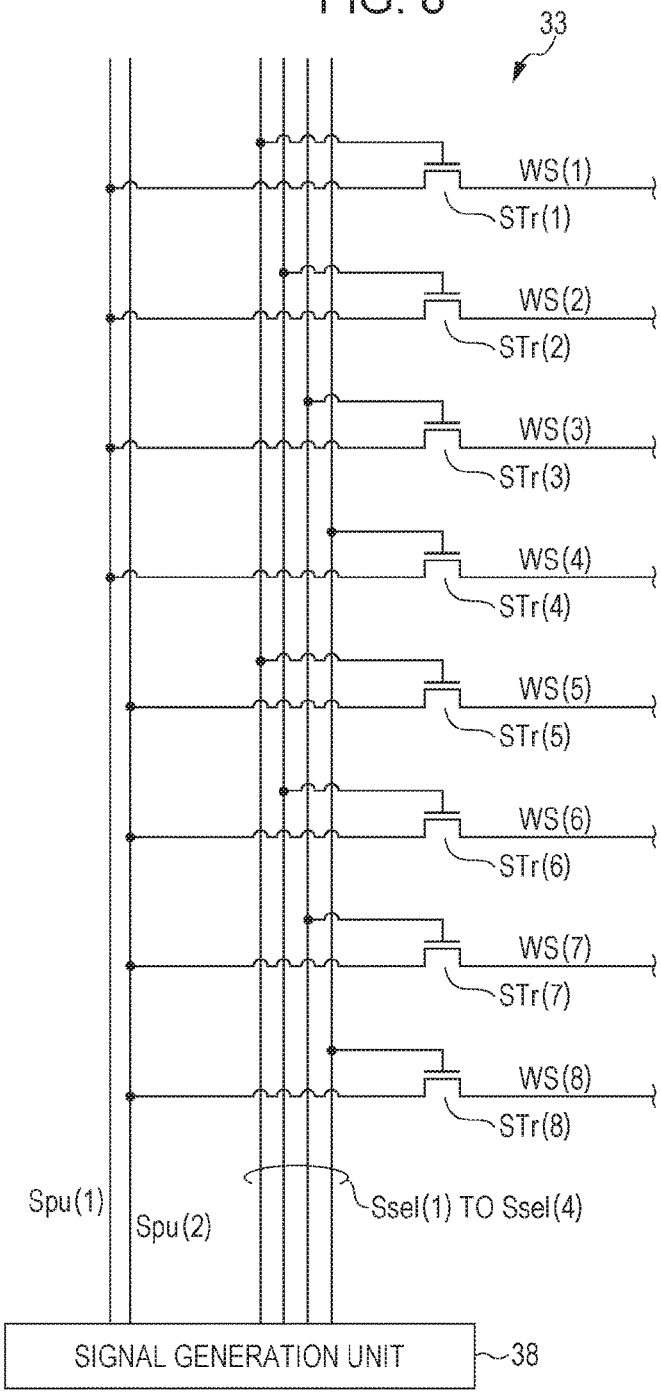
FIG. 8 is a circuit diagram illustrating one configuration example of a scanning line driving unit illustrated in FIG. 1.

FIG. 8 is a diagram illustrating one configuration example of the scanning line driving unit 33. The signal generation unit 38 of the scanning line driving unit 33 generates 2 pulse signals Spu(1) and Spu(2) and 4 selection signals Ssel(1) to Ssel(4). In transistors STr(1) to STr(4), the pulse signal Spu(1) is supplied to the sources and the selection signals Ssel(1) to Ssel(4) are supplied to the gates, respectively. In transistors STr(5) to STr(8), the pulse signal Spu(2) is supplied to the sources and the selection signals Ssel(1) to Sscel(4) are supplied to the gates, respectively. Then, the transistors STr(1) to STr(8) output scanning signals WS(1) to WS(8), respectively.

Figure 9:
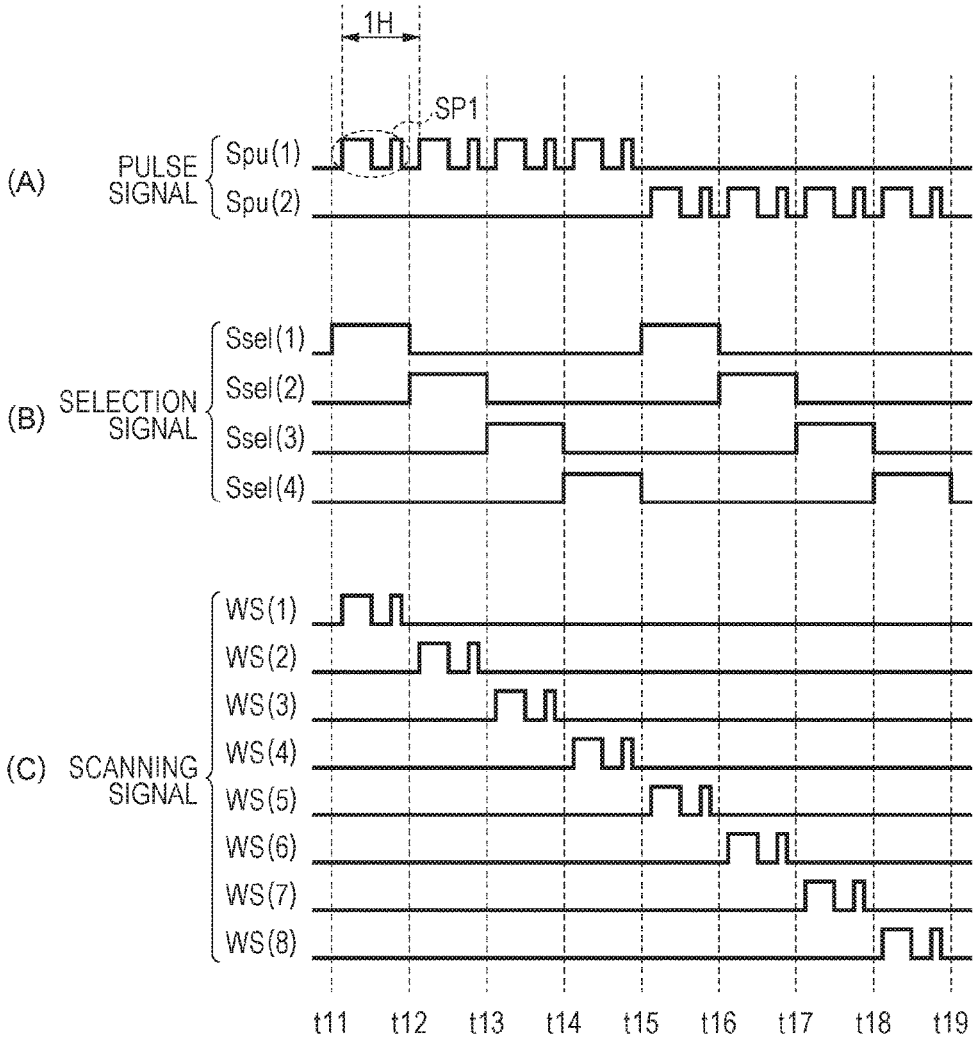
FIG. 9 is a timing waveform diagram illustrating one operation example of the scanning line driving unit illustrated in FIG. 8.

FIG. 9 is a diagram illustrating one operation example of the scanning line driving unit 33. FIG. 9(A) illustrates the waveforms of the pulse signals Spu(1) and Spu(2), FIG. 9(B) illustrates the waveforms of the selection signals Ssel (1) to Ssel(4), and FIG. 9(C) illustrates the waveforms of the scanning signals WS(1) to WS(8).

As illustrated in FIG. 9(A), the pulse signal Spu(1) is a signal that includes four pulses SP1 during a period of timings t11 to t15. The pulse signal Spu(2) is a signal that includes four pulse signals SP1 during a period of timings t15 to t19.

As illustrated in FIG. 9(B), the selection signal Ssel(1) is a signal that becomes a high level during a period of the timings t11 and t12 and a period of the timings t15 and t16 and becomes a low level during the other periods. The selection signal Ssel(2) is a signal that becomes a high level during a period of the timings t12 and t13 and a period of the timings t16 and t17 and becomes a low level during the other periods. The selection signal Ssel(3) is a signal that becomes a high level during a period of the timings t13 and t14 and a period of the timings t17 and t18 and becomes a low level during the other periods. The selection signal Ssel(4) is a signal that becomes a high level during a period of the timings T14 and t15 and a period of the timings t18 and t19 and becomes a low level during the other periods.

The transistors STr(1) to STr(4) sequentially separate the four pulses SP1 included in the pulse signal Spu(1) and output the pulses SP1 as the scanning signals WS(1) to WS(4), and the transistors STr(5) to STr(8) sequentially separate the four pulses SP1 included in the pulse signal Spu(2) and outputs the pulses SP1 as the scanning signals WS(5) to WS(8) (see FIG. 9(C)). For example, the transistor STr(1) outputs the pulse signal Spu(1) as the scanning signal WS(1) during the period in which the signal Ssel(1) is in the high level. At this time, the signal Ssel(1) becomes the high level during the period of the timings t11 and t12 and the period of the timings t15 and t16. However, since the pulse signal Spu(1) includes the pulse SP1 only during the period of the timings t11 to t15, the pulse SP1 is shown in the scanning signal WS(1) only during the period of the timings t11 and t12. The same applies also to the other transistors STr(2) to Str(8).

In this way, the scanning line driving unit 33 generates the 8 (=2×4) scanning signals WS(1) to WS(8) based on the 2 pulse signals Spu(1) and Spu(2) and the 4 selection signals Ssel(1) to Ssel(4).

The detailed operation has hitherto been described giving the example in which the scanning line driving unit 33 generates the 8 scanning signals WS(1) to WS(8). The same applies also to the scanning line driving unit 23 illustrated in FIG. 4. That is, the scanning line driving unit 23 generates 1080 (=30×36) scanning signals WS(1) to WS(1080) based on 30 pulse signals Spu(1) to Spu(30) and 36 selection signals Ssel(1) to Ssel(36).

In the display device 1, the frame region is narrowed by suppressing the numbers of elements and wirings in the region 7 (see FIG. 3) using the scanning line driving unit 23 having the configuration illustrated in FIG. 4.

That is, for example, the width of the region 7 may be increased, when the scanning line driving unit is configured using a shift register and the shift register is formed in the region 7. In particular, when the shift register is configured using an organic TFT (O-TFT) or an oxide TFT (TOS), it is necessary to increase the size of the transistors due to low mobility, and thus the width of the region 7 may be further increased. On the other hand, in the scanning line driving unit 23, the signal generation unit 28 is formed in the IC 9 and one transistor STr is formed in each scanning line WSL in the region 7. Therefore, the number of elements can be reduced, compared to the case in which the shift register is formed in the region 7. Accordingly, even when the transistors are configured to include organic TFTs (O-TFT) or oxide TFTs (TOS), the width of the region 7 can be narrowed.

Further, the scanning line driving unit 23 is configured to generate the 1080 (=30×36) scanning signals WS(1) to WS(1080) by the combination of the 30 pulse signals Spu(1) to Spu(30) and the 36 selection signals Ssel(1) to Ssel(36). Therefore, for example, the number of wirings can be reduced and the width of the region 7 can thus be narrowed, compared to the case in which a shift register or the like is formed in the IC 9 (see FIG. 3) and 1080 wirings delivering the scanning signals WS(1) to WS(1080) from the IC 9 to the display unit 10 are formed in the region 7 (see FIG. 3).

Next, reduction in the number of wirings (the pulse signal line PUL and the selection signal line SELL) will be described in detail.

When it is assumed that $x_1$ is the number of pulse signal lines PUL and $x_2$ is the number of selection signal lines SELL, $(x_1 \times x_2)$ is 1080 (the number of scanning lines WSL) in this example. Thus, examples of the combination of the x1 and x2 of which a product is 1080 include 1×1080, 2×540, 3×360, 4×270, 5×216, 6×180, 8×135, 9×120, 10×108, 12×90, 15×72, 18×60, 20×54, 24×45, 27×40, and 30×36. Among the combinations, a combination with the minimum sum is 30×36 and the sum is 66 (=30+36). That is, a configuration in which 30 pulse signal lines PUL(1) to PUL(30) and 36 selection signals SELL(1) to SELL(36) are provided is a configuration in which the number of wirings is the minimum.

As a method of calculating the minimum sum, as will be described below, a relation between an arithmetic average $\alpha$ and a geometric average $\alpha_G$ can be used.

In general, when $x_1, x_2, \ldots, x_n$ are positive numbers, the arithmetic average $\alpha$ and the geometric average $\alpha_G$ can be expressed as follows.

$$\alpha = \frac{1}{n}\sum_{i=1}^{n} x_i = \frac{x_1 + x_2 + \ldots + xn}{n} \tag{1}$$

$$\alpha_G = \sqrt[n]{\prod_{i=1}^{n} x_i} = \sqrt[n]{x_1 \times x_2 \times \ldots \times xn} \tag{2}$$

A relation such as the following equation is satisfied between the arithmetic average $\alpha$ and the geometric average $\alpha_G$.

$$\alpha \geq \alpha_G \tag{3}$$

When Equation (1) and Equation (2) are substituted into Equation (3) and are reorganized, the following equation can be obtained.

$$x_1 + x_2 + \ldots + xn \geq n \times \sqrt[n]{x_1 \times x_2 \times \ldots \times xn} \tag{4}$$

In this equation, when n is 2, Equation (4) becomes the following equation.

$$x_1 + x_2 \geq 2 \times \sqrt{x_1 \times x_2} \tag{5}$$

When Equation (5) is used, the minimum value of the number of wirings (the pulse signal lines PUL and the selection signal lines SELL) can easily be obtained. That is, the product ($x_1 \times x_2$) of the number $x_1$ of pulse signal lines PUL and the number $x_2$ of selection signal lines SELL is 1080 in this example, the sum wiring number ($x_1 + x_2$) is 65.7 (=2×√1080) or more from Equation (5). The 66 wirings described above can be understood to be close the theoretical minimum value. Thus, the minimum value of the number of wirings can easily be obtained.

In this example, the 30 pulse signal lines PUL(1) to PUL(30) and the 36 selection signal lines SELL(1) to SELL(36) are provided, but the present disclosure is not limited thereto. Instead, for example, 36 pulse signal lines PUL and 30 selection signal lines SELL may be provided. In this example, the sum wiring number is set to 66, but the present disclosure is not limited thereto. For example, 67 (27×40) wirings, 69 (24×45) wirings, or the like may be used.

Power Line Driving Unit 24

As illustrated in FIG. 5 and the like, the power signal generation unit 29 generates the 2 power signals DSA and DSB and the power signal driving unit 24 supplies the power signals DSA and DSB to the display unit 10 via the two power signal lines AL and BL disposed in the region 8 (see FIG. 3). Thus, since the number of wirings can be reduced in the region 8 (see FIG. 3), the frame region can be narrowed. That is, for example, when a power driving unit is configured using a shift register and the shift register is formed in the region 8, the width of the region 8 may be increased. In particular, as described above, when a shift register is configured using an organic TFT (O-TFT) or an oxide TFT (TOS), the width of the region 8 may be further increased. On the other hand, the power line driving unit 24 is configured such that the common power signal DSA is supplied to the sub-pixels 11 belonging to the odd rows and the common power signal DSB is supplied to the sub-pixels 11 belonging to the even rows. Since it is not necessary to form a circuit such as a shift register in the region 8 and the number of wirings can be set to two wirings (power signal lines AL and BL), the region 8 can be narrowed.

Since the power line driving unit 24 is configured to drive the display unit 10 using the 2 power signals DSA and DSB, load can be reduced. That is, for example, when the display unit 10 is driven using one power signal, it is necessary to drive all of the sub-pixels 11 of the display unit 10. Therefore, since the load is heavy, for example, there is a concern that image quality may deteriorate. The display device 1 is configured such that the sub-pixels 11 belonging to the odd rows are driven using the power signal DSA and the sub-pixels 11 belonging to the even rows are driven using the power signal DSB. Therefore, since the load can be reduced, it is possible to reduce the concern that the image quality may deteriorate.

Since the power line driving unit 24 is configured to supply the power signal DSA to the sub-pixels 11 belonging to the odd rows and supply the power signal DSB to the sub-pixels 11 belonging to the even rows, it is possible to reduce the concern that the image quality may deteriorate. That is, there is a concern that the sub-pixels 11 may emit light with slightly different luminance according to the supplied power signals DSA and DSB. In the display device 1, the rows supplied with the power signal DSA and the rows supplied with the power signal DSB are alternately disposed. Therefore, even when a luminance difference occurs, a space frequency of the luminance can be improved. Accordingly, it is possible to reduce the concern that an observer may feel the luminance difference.

As will be described below, the power line driving unit 24 can independently set a ratio (duty ratios) of a period of a high voltage level (voltage Vccp) to a period of low voltage level (voltage Vini) for each of the two power signals DSA and DSB. Thus, it is possible to reduce the luminance difference between the odd and even rows.

Figure 10:
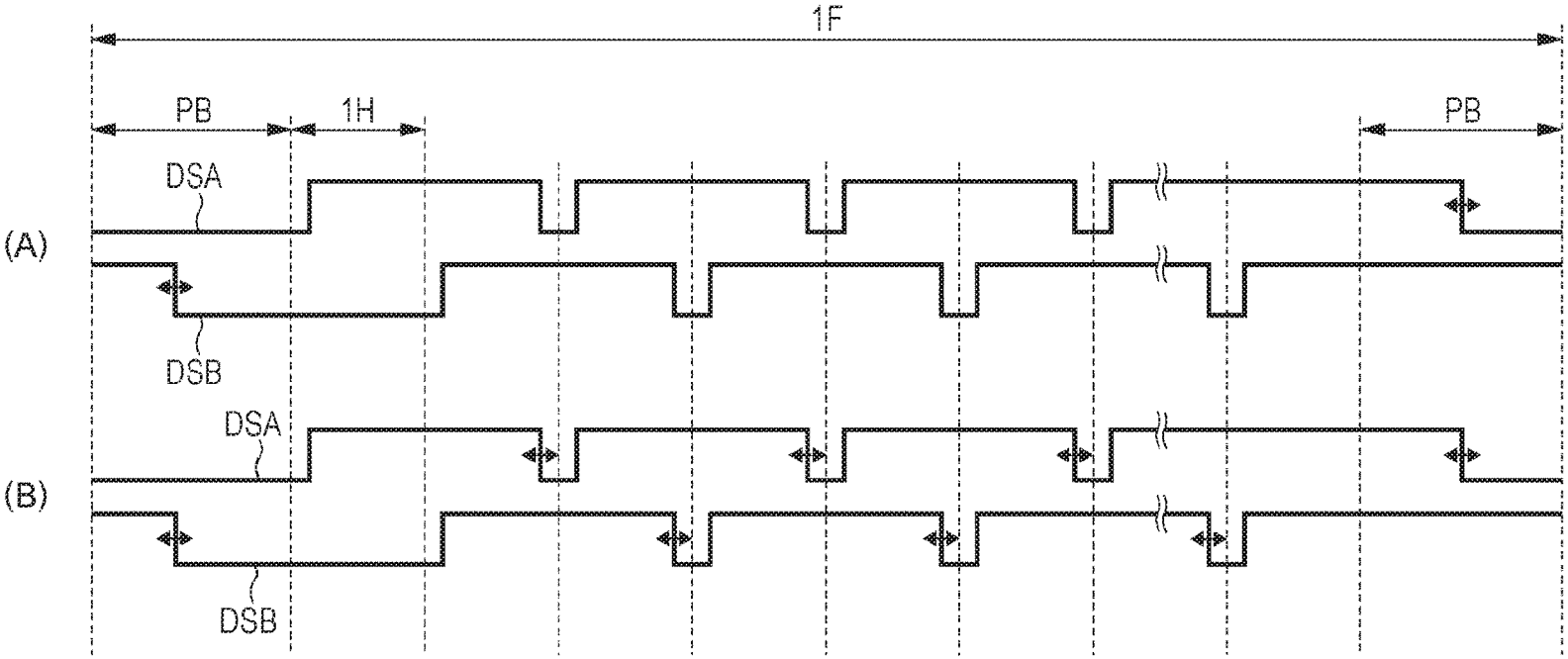
FIG. 10 is a timing waveform diagram illustrating one operation example of the power line driving unit illustrated in FIG. 1.

FIG. 10 is a diagram illustrating a duty ratio adjustment operation performed by the power line driving unit 24. FIG. 10(A) illustrating one example of the duty ratio adjustment operation and FIG. 10(B) illustrates another example of the duty ratio adjustment operation. For example, as illustrated in FIG. 10(A), the power line driving unit 24 can adjust the duty ratio by mainly adjusting the falling edges of the power signals DSA and DSB during a vertical blanking period PB. As illustrated in FIG. 10(B), the power line driving unit 24 may adjust the duty ratio by mainly adjusting timings of the falling edge of the power signals DSA and DSB during each horizontal period in addition to the vertical blanking period PB. The duty ratio can be more minutely adjusted in the method of FIG. 10(A) than in the method of FIG. 10(B). Conversely, the duty ratio can be adjusted in a broader range in the method of FIG. 10(B) than in the method of FIG. 10(A). When the duty ratio is set to be large, the light emission period P4 (see FIG. 7) is prolonged. Therefore, the luminance of a display screen can be increased. Conversely, when the duty ratio is set to be small, the light emission period P4 is shortened. Therefore, the luminance of a display screen can be decreased.

By independently setting the duty ratio for the power signals DSA and DSB, it is possible to adjust balance between the luminance of the sub-pixels 11 belonging to the even rows and the luminance of the sub-pixels 11 belonging to the odd rows. Therefore, it is possible to reduce the concern that the image quality may deteriorate. Even in this case, since it is necessary to minutely adjust the duty ratio, for example, the method illustrated in FIG. 10(A) is preferred.

Advantages

In this embodiment described above, since the signal generation unit of the scanning line driving unit is formed in the IC and one transistor is formed in each scanning line, the number of elements in the frame region can be reduced, thereby narrowing the frame region.

In this embodiment, since the scanning line driving unit is configured to generate the scanning signals according to the combination of the plurality of pulse signals and the plurality of selection signals, the number of wirings can be reduced, thereby narrowing the frame region.

In this embodiment, since the power signal generation unit of the power line driving unit is formed in the IC and is configured to supply the common power signal DSA to the sub-pixels belonging to the odd rows and supply the common power signal DSB to the sub-pixels belonging to the even rows, not only it is not necessary to form the circuit in the frame region but also the number of wirings can be reduced, thereby narrowing the frame region.

In this embodiment, since the power line driving unit is configured to drive the display unit using two power signals, the load can be reduced. Therefore, it is possible to reduce the concern that the image quality may deteriorate.

In this embodiment, since the power line driving unit is configured to supply the power signal DSA to the sub-pixels belonging to the odd rows and supply the power signal DSB to the sub-pixels belonging to the even rows, the space frequency can be increased. Therefore, it is possible to reduce the concern that the image quality may deteriorate.

In this embodiment, the power line driving unit is configured to independently set the duty ratio for each of the two power signals. Therefore, it is possible to reduce the concern that the image quality may deteriorate.

Modification Example 1-1

In the above-described embodiment, the scanning line driving unit 23 is provided with the pulse signal lines PUL and the selection signal lines SELL, but the present disclosure is not limited thereto. Instead, other signal lines may be added. Hereinafter, a modification example will be described in detail.

FIG. 11 is a diagram illustrating the values of the right side when n is set to 1 to 12 in Equation (4). This calculation is performed on the assumption that a product ($x_1 \times x_2 \times \ldots \times x_n$) of $x_1$ to $x_n$ is 1080. When n=2, the example in which the sum wiring number is 65.7 or more has already been described. For example, when n=3, the sum wiring number is 30.8 or more. When n=4, the sum wiring number is 22.9 or more. This means that the sum wiring number can be further reduced when third signal lines are provided (n=3) or the third signal lines and fourth signal lines are provided (n=4) in addition to the pulse signal lines PUL and the selection signal lines SELL.

FIG. 12 is a diagram illustrating a setting example of $x_1$ to $x_4$ when n=1 to 4. For example, when n=3, the sum wiring number can be set to 31 by setting $x_1$ to $x_3$, as illustrated in FIG. 12. Therefore, it is possible to realize a value close to the theoretical minimum value (30.8) illustrated in FIG. 11.

Figure 13:
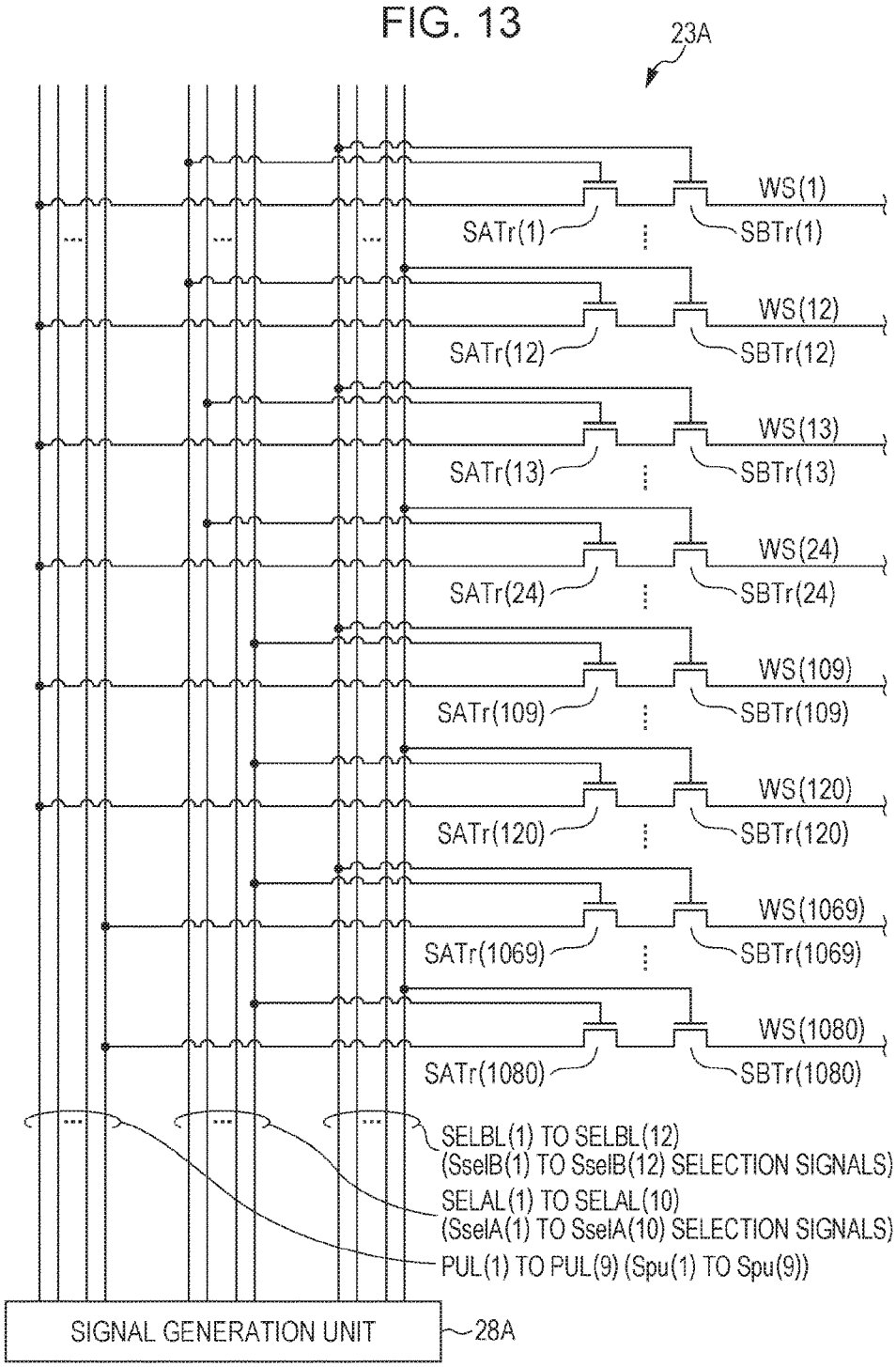
FIG. 13 is a circuit diagram illustrating one configuration example of a scanning line driving unit according to a modification example of the first embodiment.

FIG. 13 is a diagram illustrating one configuration example of a scanning line driving unit 23A when n=3. The scanning line driving unit 23A includes a signal generation unit 28A and a plurality of transistors SATr and SBTr.

The signal generation unit 28A generates 9 pulse signals Spu (pulse signals Spu(1) to Spu(9)) based on a control signal (not illustrated) supplied from the timing generation unit 22 and applies the pulse signals Spu to pulse signal lines PUL (pulse signal lines PUL(1) to PUL(9)). The signal generation unit 28A generates 10 selection signals SselA (selection signals SselA(1) to SselA(10)) and applies the selection signals SselA to selection signal lines SELAL (selection signal lines SELAL(1) to SELAL(10)). The signal generation unit 28A generates 12 selection signals SselB (selection signals SselB(1) to SselB(12)) and applies the selection signals SselB to selection signal lines SELBL (selection signal lines SELBL(1) to SELBL(12)). The selection signals SselA(1) to SselA(10) are used to turn on and off the plurality of transistors SATr and the selection signals SselB(1) to SselB(12) are used to turn on and off the plurality of transistors SBTr.

The transistors SATr (transistors SATr(1) to SATr(1080)) and the transistors SBTr (transistors SBTr(1) to SBTr(1080)) are provided to correspond to the scanning lines WSL of the display unit 10, respectively. In the transistors SATr(1) to SATr(1080), each source is connected to any one of the pulse signal lines PUL(1) to PUL(9), each gate is connected to any one of the selection signal lines SELAL(1) to SELAL(10), and each drain is connected to the sources of the corresponding transistors SBTr(1) to SBTr(1080). In the transistors SBTr(1) to SBTr(1080), each source is connected to the drains of the corresponding transistors SATr(1) to SATr (1080), each gate is connected to any one of the selection signal lines SELBL(1) to SELBL(12), and each drain is connected to the corresponding scanning lines WSL in the display unit 10. Specifically, for example, in the transistors SATr(1) to SATr(12), the sources are connected to the pulse signal line PUL(1), the gates are connected to the selection signal line SELAL(1). The gates of the transistors SBTr(1) to SBTr(12) are connected to the selection signal lines SELBL(1) to SELBL(12), respectively. For example, in the transistors SATr(13) to SATr(24), the sources are connected to the pulse signal line PUL(1) and the gates are connected to the selection signal line SELAL(2). The gates of the transistors SBTr(13) to SBTr(24) are connected to the selection signal lines SELBL(1) to SELBL(12), respectively.

By realizing such a configuration, the sum wiring number can be further reduced.

Modification Example 1-2

In the above-described embodiment, the power line driving unit 24 has alternately supplied the power signals DSA and DSB in one unit to the power lines PL, but the present disclosure is not limited thereto. Instead, for example, the power signals DSA and DSB may alternately be supplied in a plurality of units. Hereinafter, an example in which the power signals DSA and DSB are alternately supplied in two units will be described.

Figure 14:
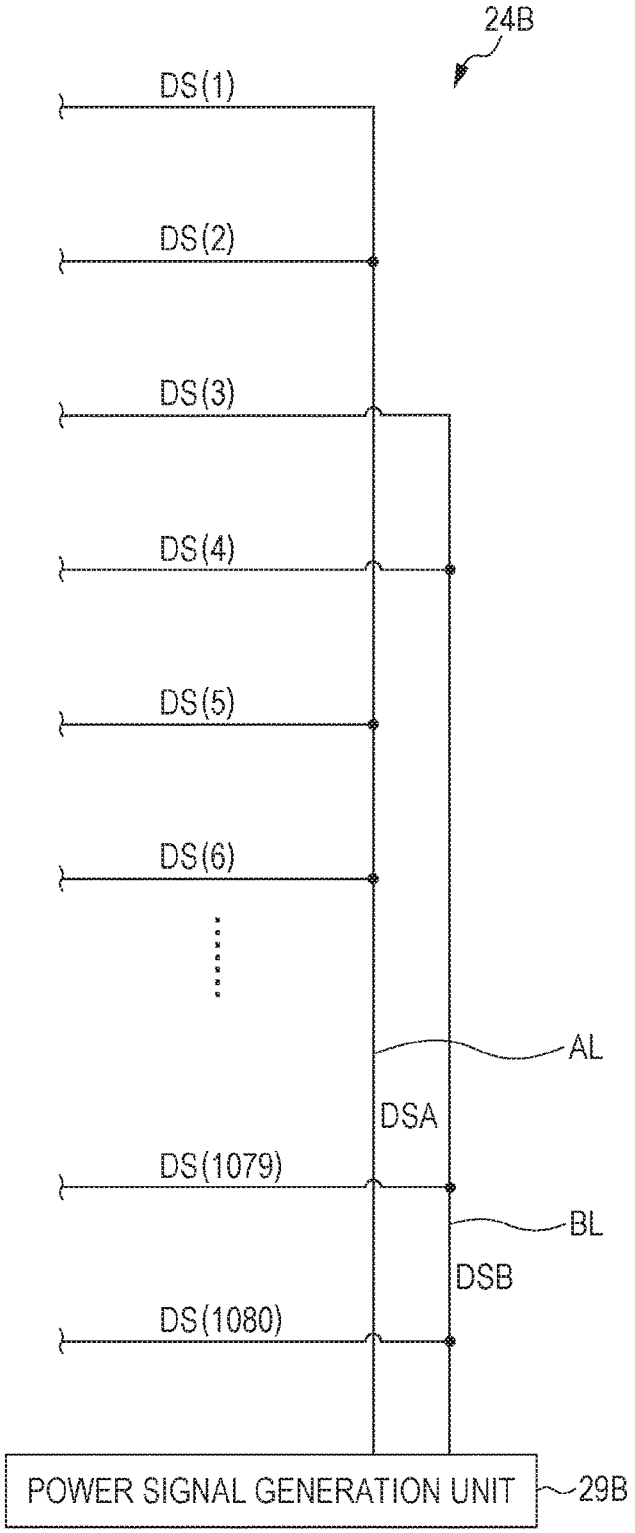
FIG. 14 is a circuit diagram illustrating one configuration example of a power line driving unit according to another modification example of the first embodiment.

FIG. 14 is a diagram illustrating one configuration example of a power line driving unit 24B in a display device 1B according to a modification example. The power line driving unit 24B includes a power signal generation unit 29B. In this example, the power signal generation unit 29B is configured to supply the power signal DSA to the power lines PL of 1st row, 2nd row, 5th row, 6th row and the like via the power signal line AL in the display unit 10 and supply the power signal DSB to the power lines PL of 3rd row, 4th row, 7th row, 8th row and the like via the power signal line BL.

Figure 15:
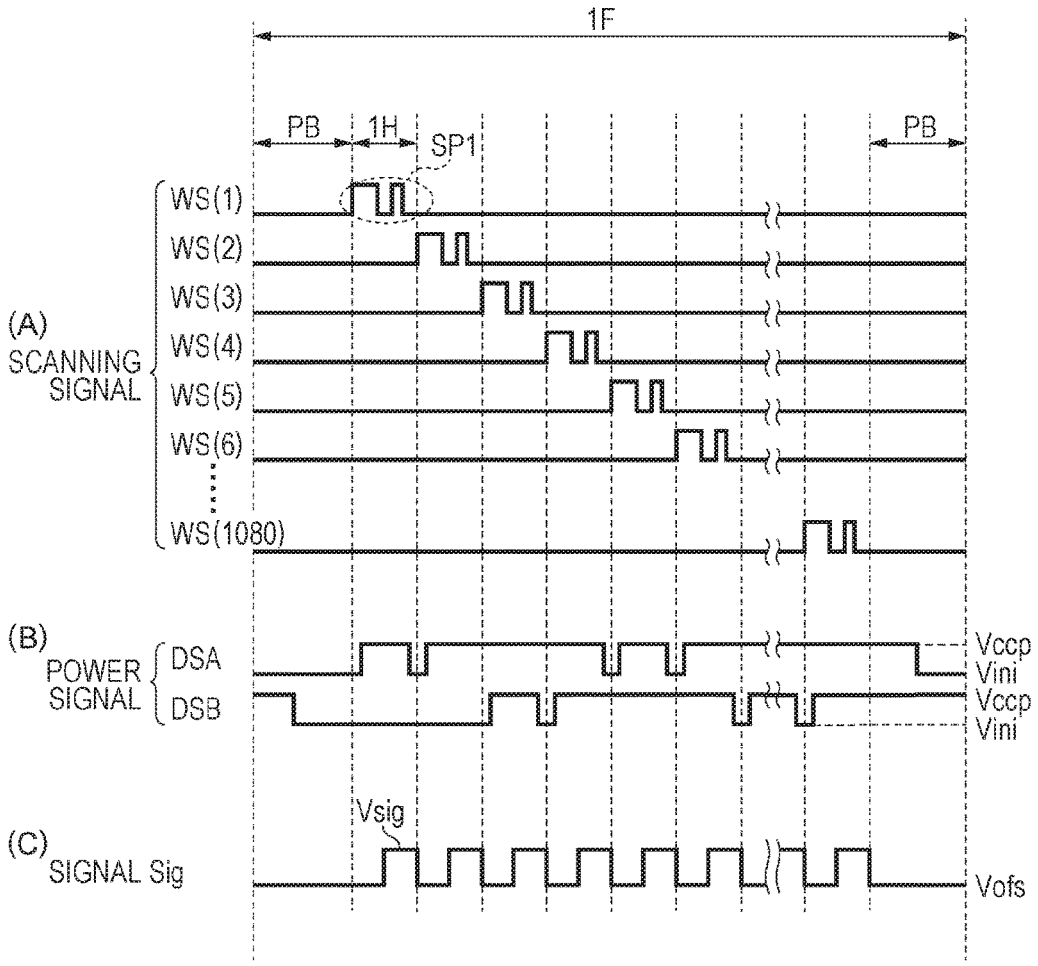
FIG. 15 is a timing waveform diagram illustrating one operation example of the power line driving unit illustrated in FIG. 14.
Figure 16:
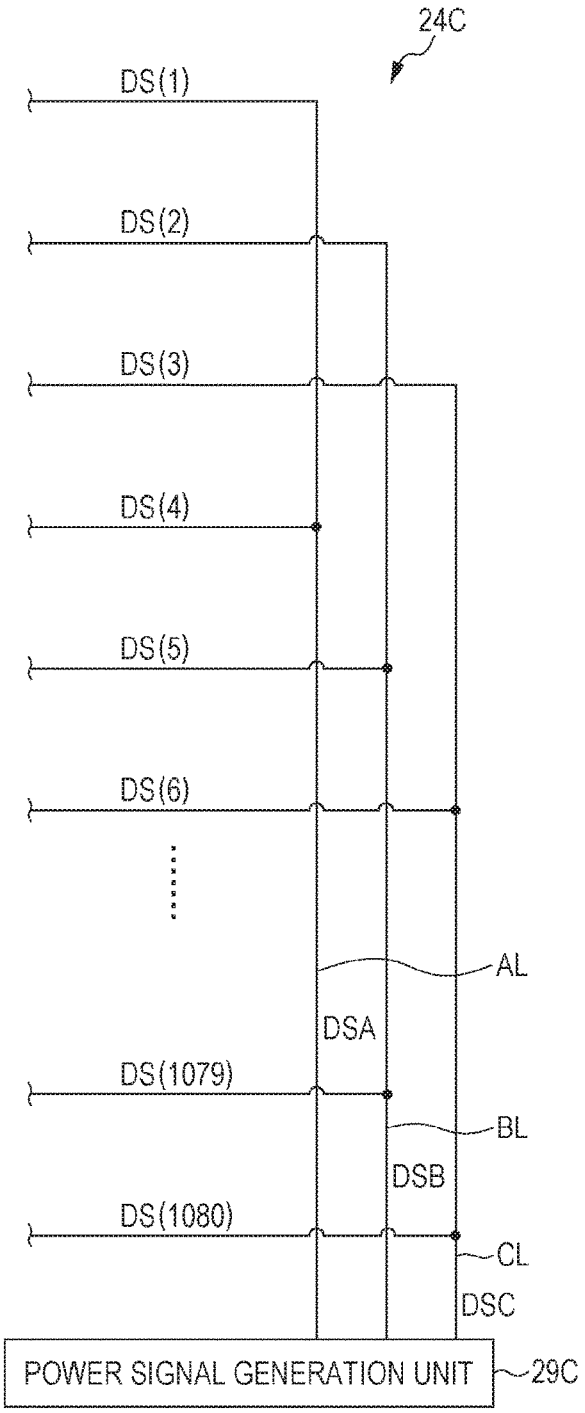
FIG. 16 is a circuit diagram illustrating one configuration example of a power line driving unit according to still another modification example of the first embodiment.

FIG. 15 is a diagram illustrating one operation example of a display device 1B during one frame period (1F). FIG. 15(A) illustrates the waveforms of scanning signals WS, FIG. 15(B) illustrates the waveforms of the power signals DSA and DSB, and FIG. 15(C) illustrates the waveform of the signal Sig. The power line driving unit 24B sets the power signal DSA to the voltage Vini during the first one horizontal period (1H) in which the pulse SP1 is shown in the scanning signals WS of the 1st row, the 2nd row, the 5th row, the 6th row, and the like and sets the power signal DSB to the voltage Vini during the first one horizontal period (1H) in which the pulse SP1 is shown in the scanning signals WS of the 3rd row, the 4th row, the 7th row, the 8th row, and the like.

By realizing such a configuration, it is possible to obtain the same advantages as those of the above-described embodiment.

Modification Example 1-3

In the above-described embodiment, the power line driving unit 24 has supplied the power signals DSA and DSB to the display unit 10 via the two power signal lines AL and BL, respectively, but the present disclosure is not limited thereto. Instead, for example, as illustrated in 16, power signals DSA, DSB, and DSC may be supplied to the display unit 10 via three power signal lines AL, BL, and CL, respectively. Thus, it is possible to reduce load on a power signal generation unit 29C.

Modification Example 1-4

In the above-described embodiment, the power signals DS (the power signals DSA and DSB) transition between the voltage Vccp and the voltage Vini, but the present disclosure is not limited thereto. Hereinafter, a modification example will be described in detail.

Figure 17:
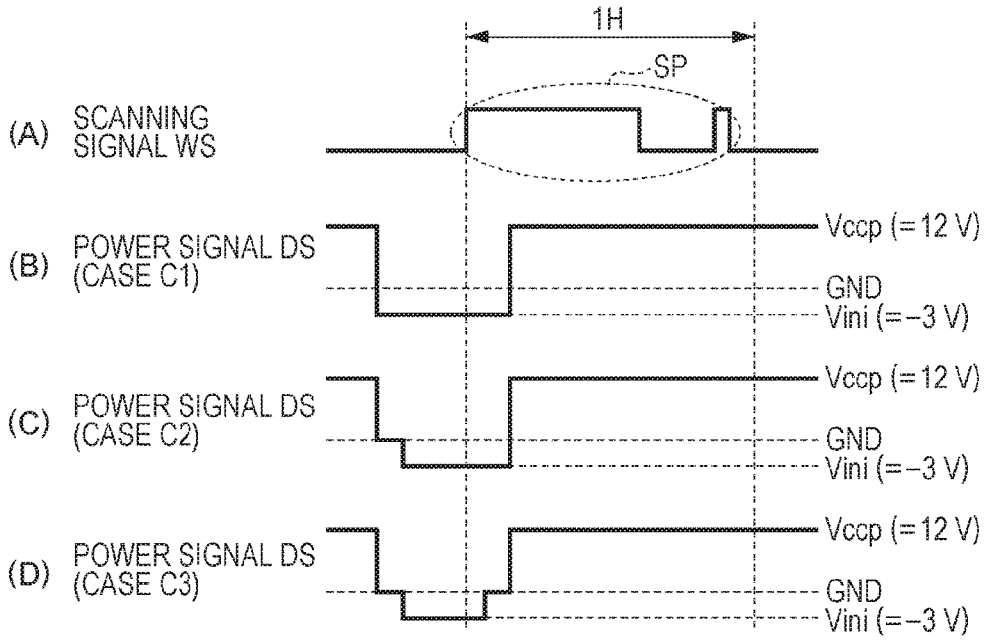
FIG. 17 is a timing waveform diagram illustrating power signals according to still another modification example of the first embodiment.

FIG. 17(A) illustrates the waveform of a scanning signal WS, FIG. 17(B) illustrates the waveform of a power signal DS (case C1) according to the above-described embodiment, and FIG. 17(C) and FIG. 17(D) illustrate the waveforms (cases C2 and C3) of power signals DS according to the modification example. In this example, the voltage Vccp is 12 V and the voltage Vini is (−3 V). As illustrated in FIG. 17(C), when the power signal DS is changed from the voltage Vccp to the voltage Vini, the power signal DS may be change in two steps via 0 V (GND). Further, as illustrated in FIG. 17(D), when the power signal DS is changed from the voltage Vini to the voltage Vccp, the power signal DS may be changed in two steps via 0 V (GND). Thus, by performing the driving in the two steps, it is possible to reduce the load on the power circuit generating the voltage Vccp and the voltage Vini.

Figure 18:
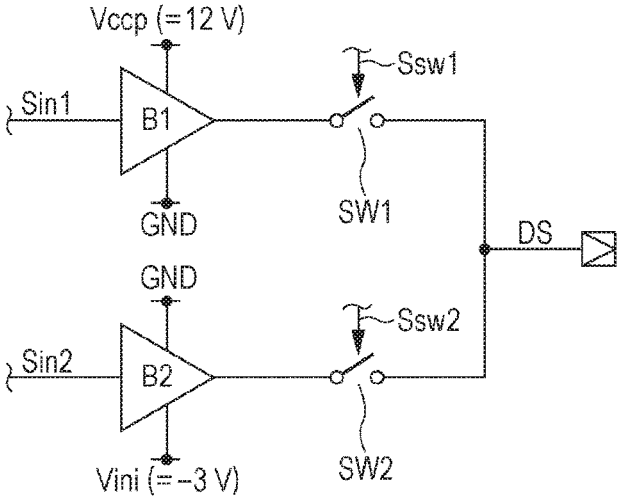
FIG. 18 is a circuit diagram illustrating one configuration example of a circuit generating the power signals illustrated in FIG. 17.

FIG. 18 is a diagram illustrating an example of a circuit generating the power signal DS in the case C3. The circuit includes buffers B1 and B2 and switches SW1 and SW2. The buffer B1 generates a signal DS1 transitioning between the voltage Vccp and 0 V (GND) based on an input signal Sin1. The buffer B2 generates a signal DS2 transitioning between 0 V (GND) and the voltage Vini based on an input signal Sin2. The switch SW1 outputs the signal DS1 as the power signal DS based on a control signal Ssw1. The switch SW2 outputs the signal DS2 as the power signal DS based on a control signal Ssw2.

Figure 19:
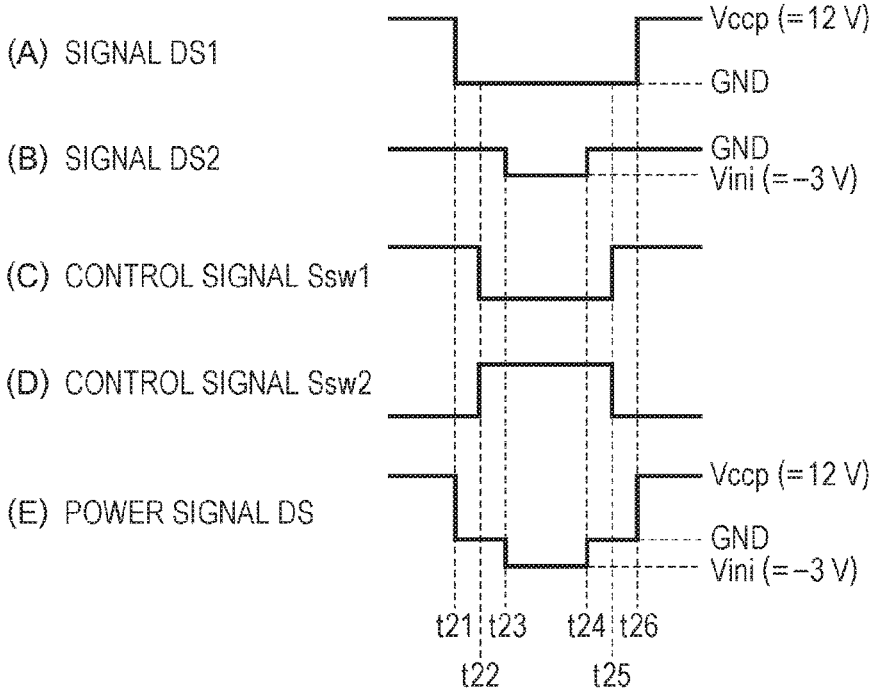
FIG. 19 is a timing waveform diagram illustrating one operation example of the circuit illustrated in FIG. 18.

FIG. 19 is a diagram illustrating an example of an operation of generating the power signals DS. FIG. 19(A) illustrates the waveform of the signal DS1, FIG. 19(B) illustrates the waveform of the signal DS2, FIG. 19(C) illustrates the waveform of the control signal Ssw1, FIG. 19(D) illustrates the waveform of the control signal Ssw2, and FIG. 19(E) illustrates the waveform of the power signal DS. Here, the switches SW1 and SW2 are assumed to enter the ON state when the control signals Ssw1 and Ssw2 are in a high level.

First, at a timing t21, the buffer B1 changes the signal DS1 from the voltage Vccp to 0 V (GND) (see FIG. 19(A)). Accordingly, the power signal DS is also changed from the voltage Vccp to 0 V (GND) (see FIG. 19(E)).

Next, at a timing t22, the switch SW1 is changed from the ON state to the OFF state (see FIG. 19(C)) and the switch SW2 is changed from the OFF state to the ON state (see FIG. 19(D)).

Next, at a timing t23, the buffer B2 changes the signal DS2 from 0 V (GND) to the voltage Vini (see FIG. 19(B)). Accordingly, the power signal DS is also changed from 0 V (GND) to the voltage Vini (see FIG. 19(E)).

Next, at a timing t24, the buffer B2 changes the signal DS2 from the voltage Vini to 0 V (GND) (see FIG. 19(B)). Accordingly, the power signal DS is also changed from the voltage Vini to 0 V (GND) (see FIG. 19(E)).

Next, at a timing t25, the switch SW1 is changed from the OFF state to the ON state (see FIG. 19(C)) and the switch SW2 is also changed from the ON state to the OFF state (see FIG. 19(D)).

Next, at a timing t26, the buffer B1 changes the signal DS1 from 0 V (GND) to the voltage Vccp (see FIG. 19(A)). Accordingly, the power signal DS is also changed from 0 V (GND) to the voltage Vccp (see FIG. 19(E)).

Thus, the power signal DS (case C3) transitioning in two steps can be generated. At this time, since the signal DS1 generated by the buffer B1 is the signal transitioning between the voltage Vccp (=12 V) and 0 V (GND), the buffer B1 performs driving such that an output voltage is changed by 12 V. Further, since the signal DS2 generated by the buffer B2 is the signal transitioning between 0 V (GND) and the voltage Vini (=−3 V) and, the buffer B2 performs driving such that an output voltage is changed by 3 V. Thus, since the buffers B1 and B2 may not perform driving such that the output voltage is change by the amplitude (by 15 V) of the power signal DS, the load can be reduced.

Figure 20:
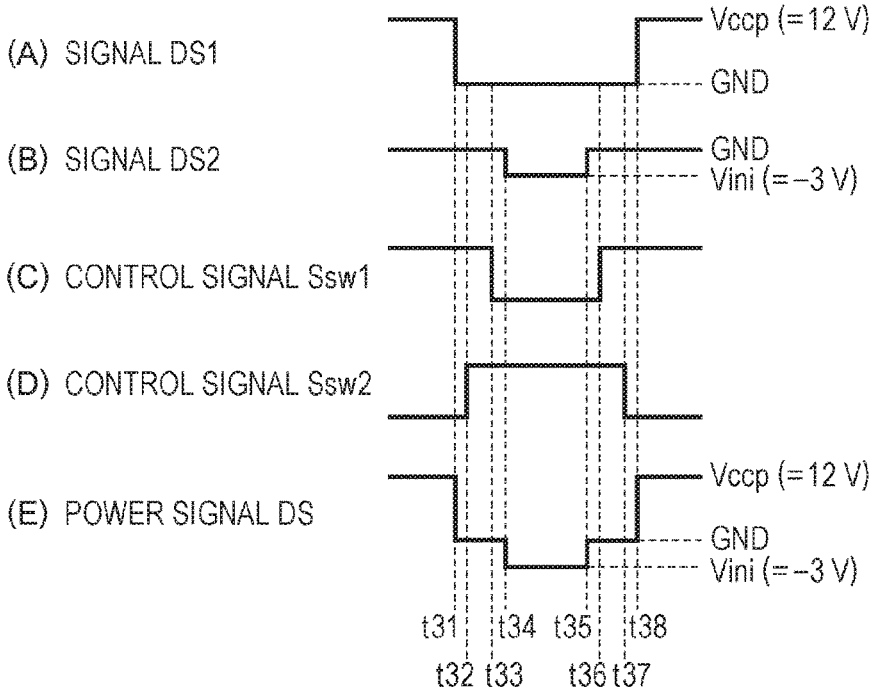
FIG. 20 is a timing waveform diagram illustrating another operation example of the circuit illustrated in FIG. 18.

In this example, the switches SW1 and SW2 are simultaneously switched, but the present disclosure is not limited thereto. For example, as illustrated in FIG. 20, the switches SW1 and SW2 may simultaneously enter the ON state during given periods (a period of timings t32 and t33 and a period of timings t36 and t37).

Modification Example 1-5

In the above-described embodiment, the sub-pixel 11 having the "2Tr1C" configuration has been described, but the present disclosure is not limited thereto. Hereinafter, a display device 1E relevant to a "3Tr1C" configuration will be described in detail.

Figure 21:
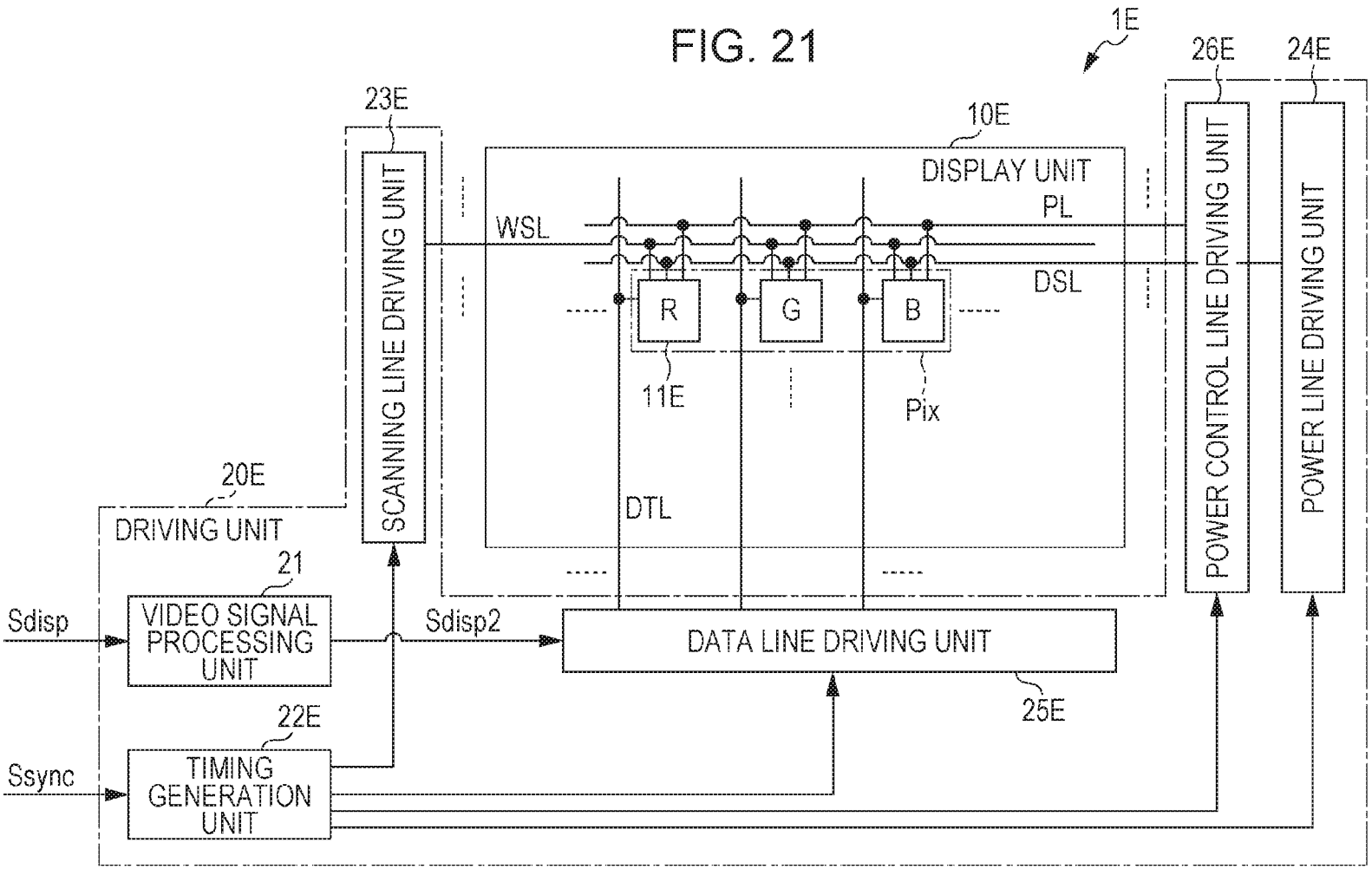
FIG. 21 is a block diagram illustrating one configuration example of a display device according to still another modification example of the first embodiment.

FIG. 21 is a diagram illustrating one configuration example of a display device 1E. The display device 1E includes a display unit 10E and a driving unit 20E. The display unit 10E includes a plurality of sub-pixels 11E and a plurality of power control lines DSL extending in the row direction. One end of the power control line DSL is connected to the driving unit 20E.

Figure 22:
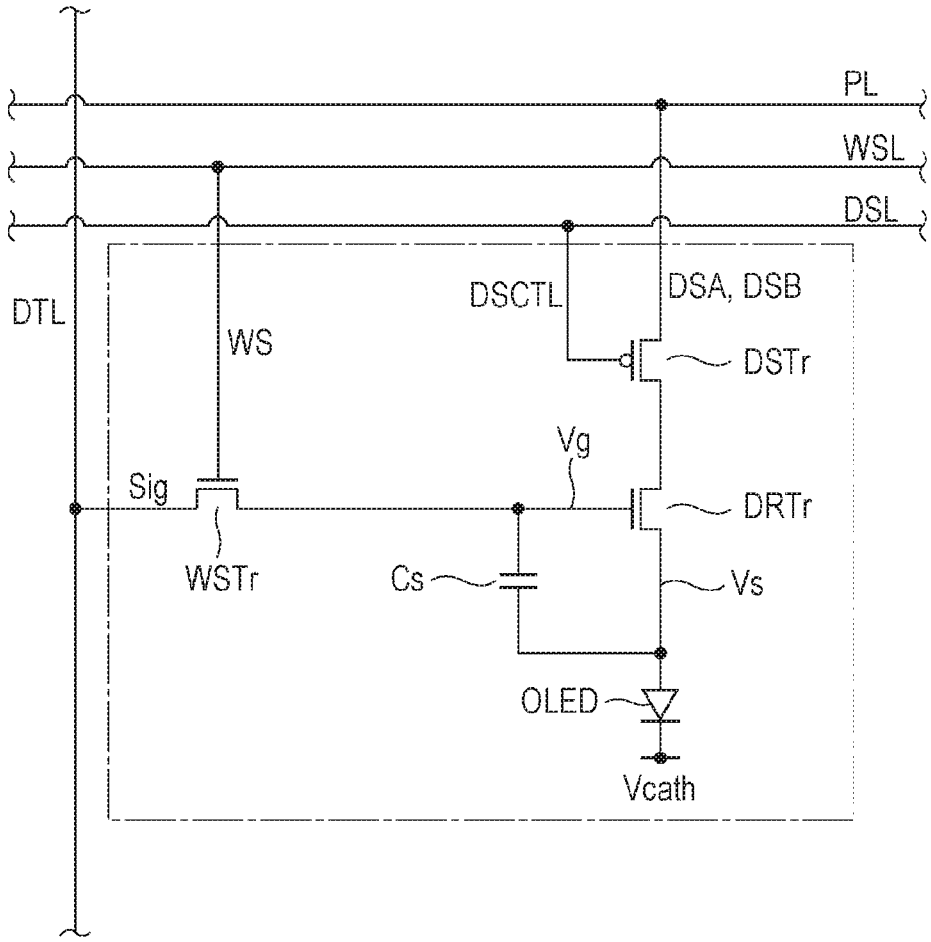
FIG. 22 is a circuit diagram illustrating one configuration example of a sub-pixel illustrated in FIG. 21.

FIG. 22 is a diagram illustrating an example of the circuit configuration of the sub-pixel 11E. The sub-pixel 11E includes a power transistor DSTr. That is, in this example, the sub-pixel 11E has the so-called "3Tr1C" configuration realized by three transistors (a write transistor WSTr, a driving transistor DRTr, and a power transistor DSTr) and one capacitative element Cs. The power transistor DSTr is configured to include a P channel MOS type TFT. In the power transistor DSTr, the gate is connected to the power control line DSL, the source is connected to the power line PL, and the drain is connected to the drain of the driving transistor DRTr.

The driving unit 20E includes a timing generation unit 22E, a power control line driving unit 26E, a scanning line driving unit 23E, a power line driving unit 24E, and a data line driving unit 25E. The timing generation unit 22E is a circuit that supplies a control signal to each of the scanning line driving unit 23E, the power line driving unit 24E, the data line driving unit 25E, and a power control line driving unit 26E based on a synchronization signal Ssync supplied from the outside and performs control such that these units are mutually synchronized and operate. The power control line driving unit 26E controls a light emission operation and a light extinction operation of the sub-pixels 11 by sequentially applying a power control signal DSCTL to the plurality of power control lines DSL according to the control signal supplied from the timing generation unit 22E. The scanning line driving unit 23E, the power line driving unit 24E, and the data line driving unit 25E have the same functions as the scanning line driving unit 23, the power line driving unit 24, and the data line driving unit 25 according to the above-described embodiment.

Figure 23:
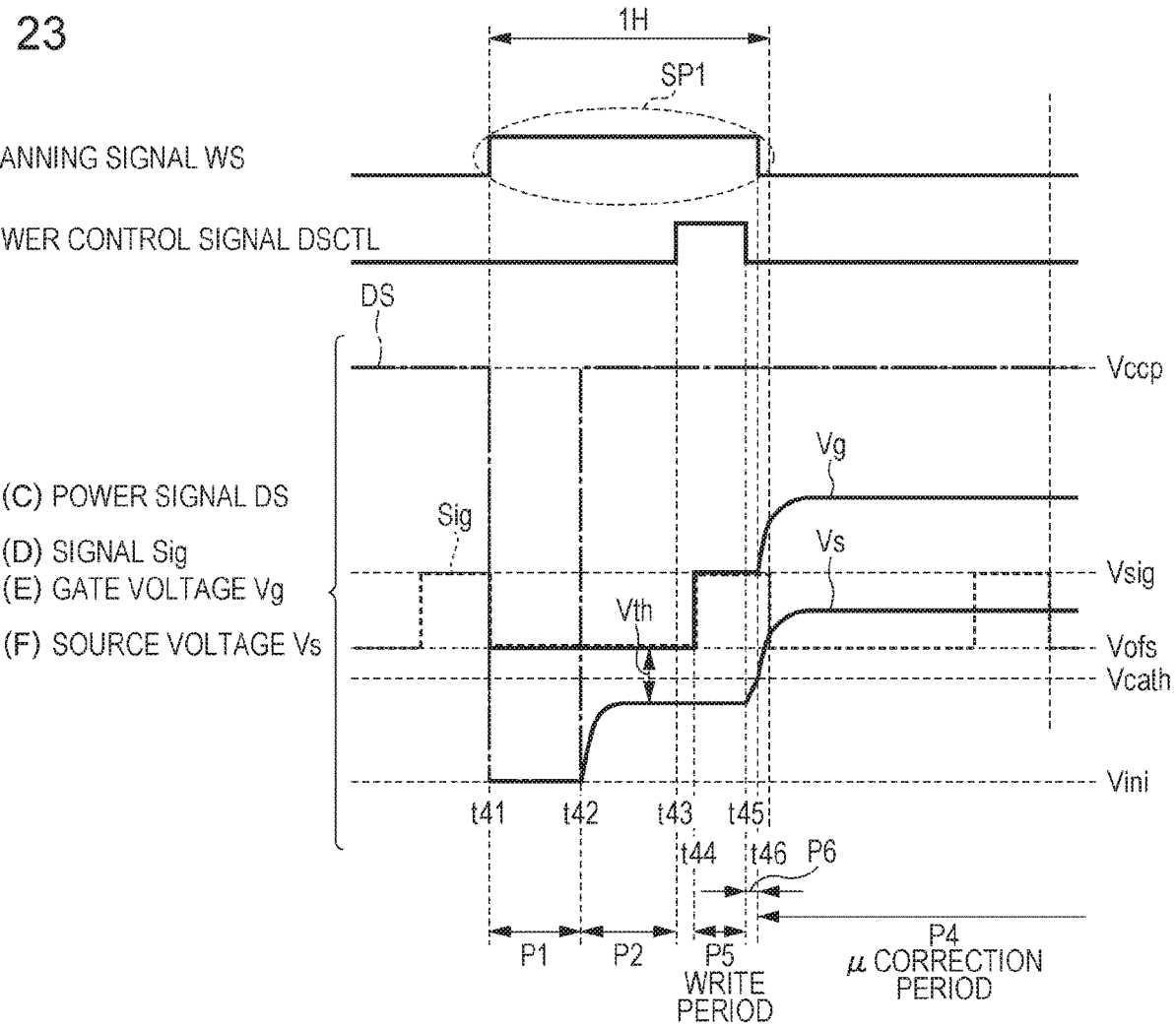
FIG. 23 is a timing waveform diagram illustrating one operation example of the sub-pixel illustrated in FIG. 21.

FIG. 23 is a timing diagram illustrating a display operation in the display device 1E. FIG. 23(A) illustrates the waveform of the scanning signal WS, FIG. 23(B) illustrates the waveform of the power control signal DSCTL, FIG. 23(C) illustrates the waveform of the power signal DS, FIG. 23(D) illustrates the waveform of a signal Sig, FIG. 23(E) illustrates the waveform of a gate voltage Vg of the driving transistor DRTr, and FIG. 23(F) illustrates the waveform of a source voltage Vs of the driving transistor DRTr.

First, the driving unit 20E initializes the sub-pixels 11E during a period (initialization period P11) of timings t41 and t42. Specifically, first, at the timing t41, the data line driving unit 25E sets the signal Sig to the voltage Vofs (see FIG. 23(D)) and the scanning line driving unit 23E changes the voltage of the scanning signal WS from a low level to a high level (see FIG. 23(A)). Simultaneously, the power line driving unit 24E changes the power signal DS from the voltage Vccp to the voltage Vini (see FIG. 23(C)). Thus, the gate voltage Vg of the driving transistor DRTr is set to the voltage Vofs (see FIG. 23(E)), the source voltage Vs of the driving transistor DRTr is set to the voltage Vini (see FIG. 23(F)), and thus the sub-pixel 11E is initialized.

Next, the driving unit 20E performs the Vth correction during a period of timings t42 and t43 (Vth correction period P2), as in the above-described embodiment.

Next, at the timing t43, the power control line driving unit 26E changes the voltage of the power control signal DSCTL from a low level to a high level (see FIG. 23(B)). Thus, the power transistor DSTr enters the OFF state.

Next, the driving unit 20E writes the pixel voltage Vsig on the sub-pixel 11E during a period (write period P5) of timings t44 and t45. Specifically, at the timing t44, the data line driving unit 25E sets the signal Sig to the pixel voltage Vsig (see FIG. 23(D)). Thus, the gate voltage Vg of the driving transistor DRTr increases from the voltage Vofs to the pixel voltage Vsig (see FIG. 23(E)). Then, the voltage Vgs between the gate and the source of the driving transistor DRTr is greater than a threshold voltage Vth (Vgs>Vth).

Next, the driving unit 20E performs μ correction during a period (μ correction period P6) of timings t45 and t46. Specifically, at the timing t45, the power control line driving unit 26E changes the voltage of the power control signal DSCTL from the high level to the low level (see FIG. 23(B)). Thus, since the power transistor DSTr enters the ON state and the current Ids flows from the drain to the source, the source voltage Vs of the driving transistor DRTr increases (see FIG. 23(F)). The μ correction is performed through the above-described operation.

Figure 24:
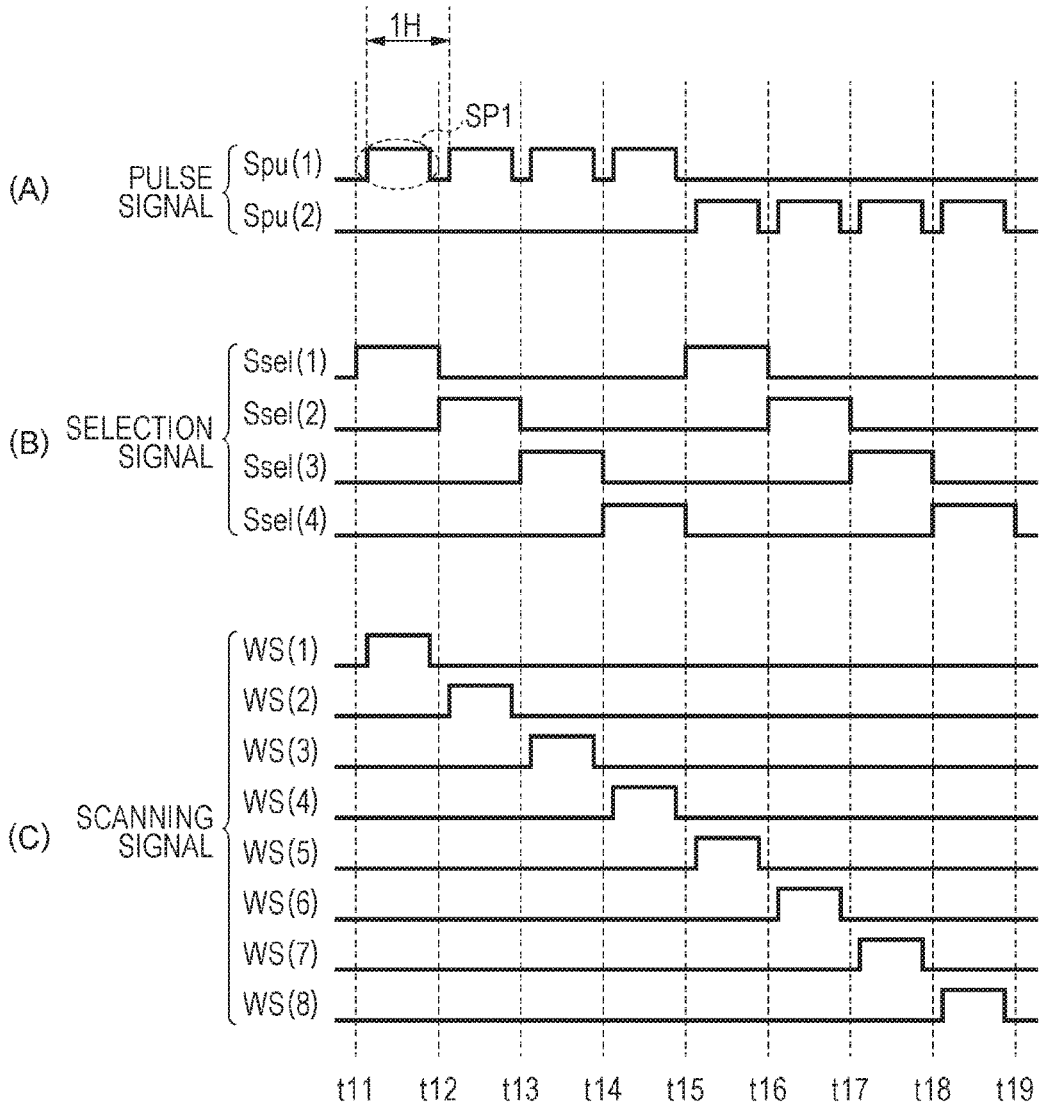
FIG. 24 is a timing waveform diagram illustrating one operation example of a scanning line driving unit illustrated in FIG. 21.

FIG. 24 is a diagram illustrating a detailed operation of the scanning line driving unit 26E. In this example, as described above in the embodiment, a case will be described in which the number of scanning lines WSL is assumed to be 8 and 8 scanning signals WS(1) to WS(8) are generated to facilitate the description. FIG. 24(A) illustrates the waveforms of the pulse signals Spu(1) and Spu(2), FIG. 24(B) illustrates the waveforms of the selection signals Ssel(1) to Ssel(4), and FIG. 24(C) illustrates the waveforms of the scanning signals WS(1) to WS(8). The pulse signals Spu(1) and Spu(2) have the waveforms including the pulse SP1 illustrated in FIG. 23. The other operations are the same as those of the above-described embodiment.

2. Second Embodiment

Next, a display device 2 according to a second embodiment will be described. In this embodiment, a frame region is narrowed by reducing the number of data lines DTL and decreasing the circuit size of a data line driving unit. The same reference numerals are given to substantially the same constitute units as those of the display device 1 according to the above-described first embodiment, and the description thereof will be appropriately omitted.

Figure 25:
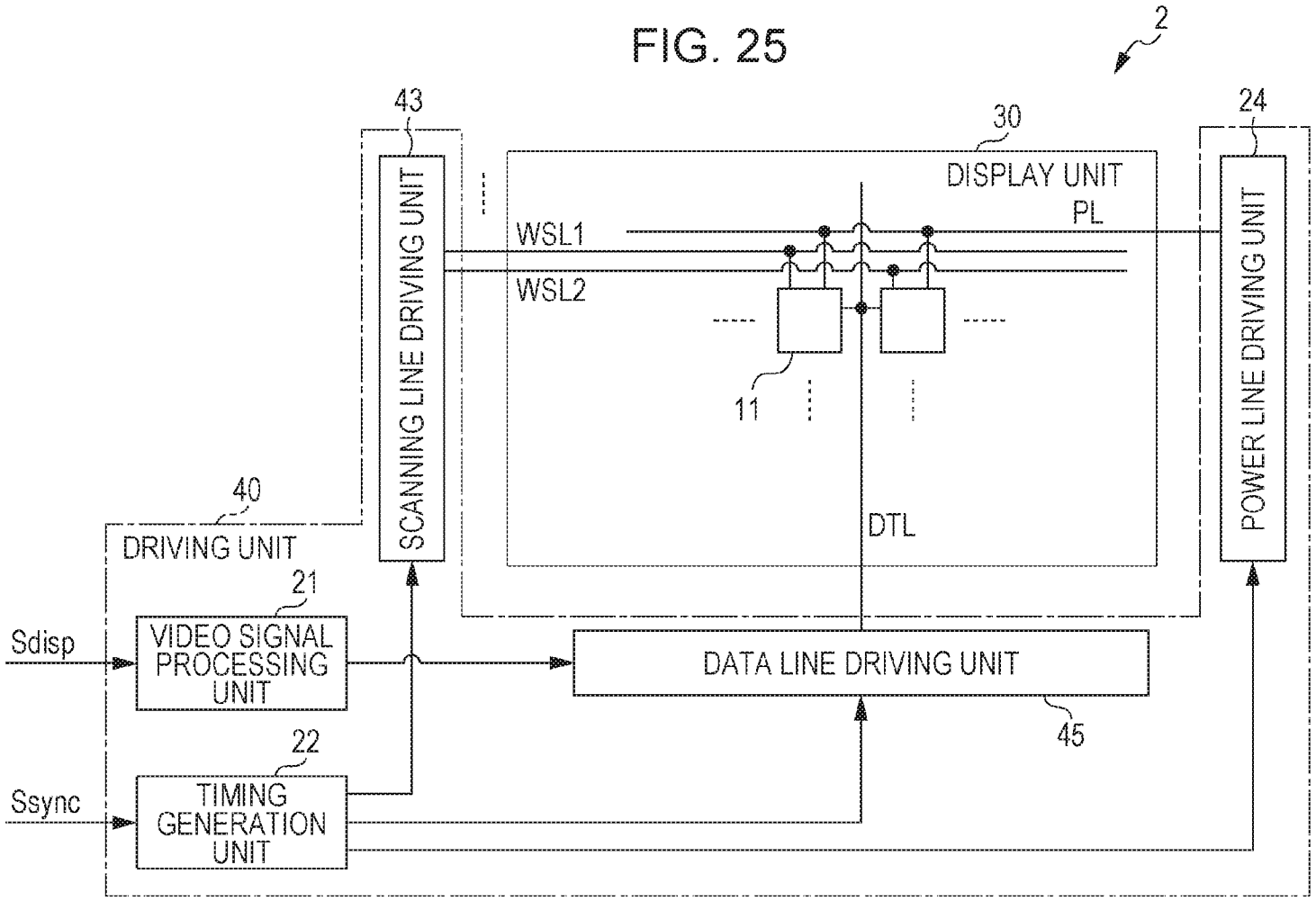
FIG. 25 is a block diagram illustrating one configuration example of a display device according to a second embodiment.

FIG. 25 is a diagram illustrating one configuration example of the display device 2. The display device 2 includes a display unit 30 and a driving unit 40.

The display unit 30 includes a plurality of scanning lines WSL1 and WSL2 and a plurality of power lines PL extending in the row direction and a plurality of data lines DTL extending in the column direction. One end of each of the scanning lines WSL1 and WSL2, the power lines PL, and the data lines DTL is connected to the driving unit 40. Hereinafter, one of the scanning lines WSL1 and WSL2 is assumed to be illustrated and is appropriately used as the scanning line WSL.

Figure 26:
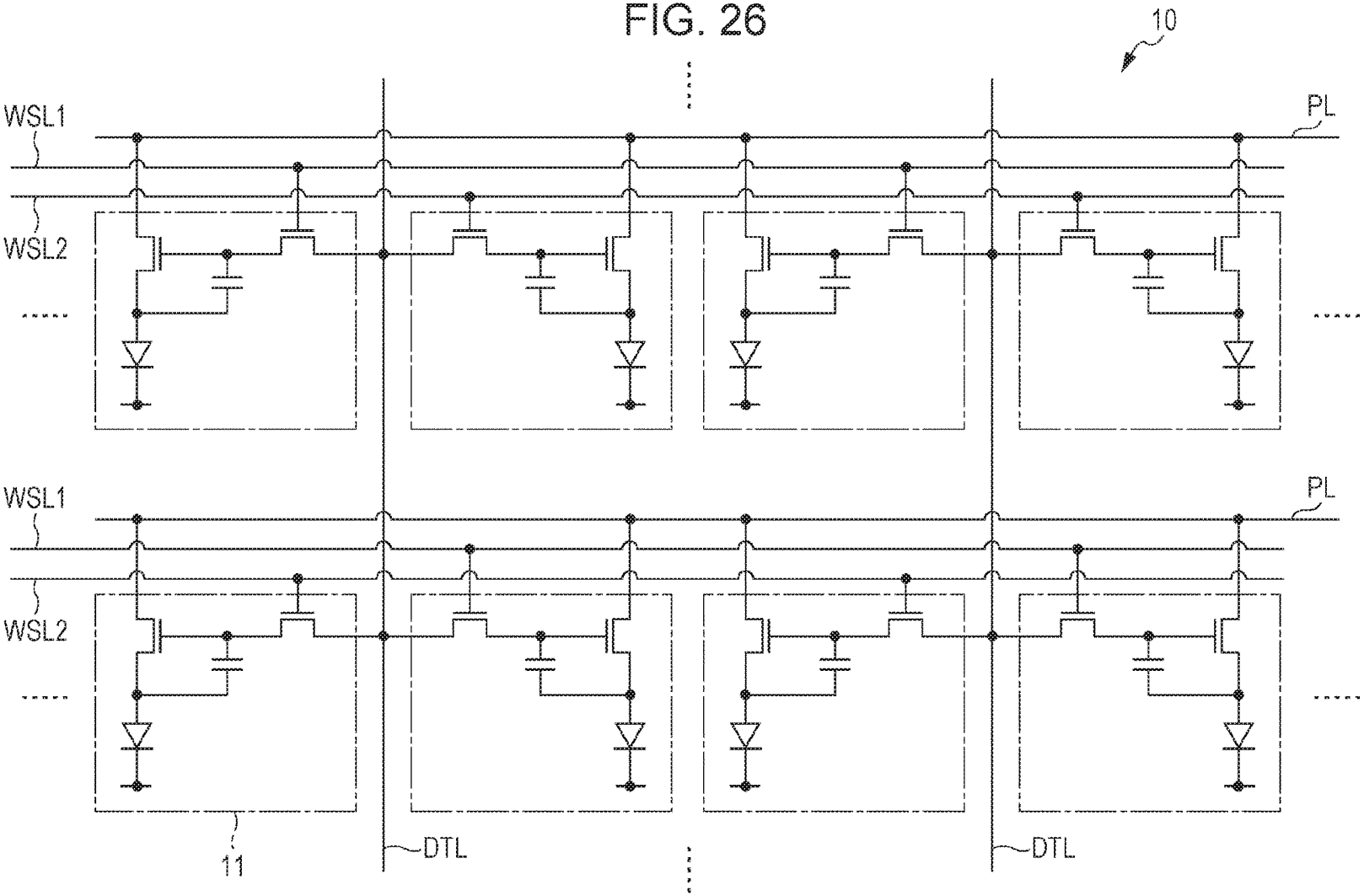
FIG. 26 is a circuit diagram illustrating one configuration example of a display unit illustrated in FIG. 25.

FIG. 26 is a diagram illustrating connection of the sub-pixels 11 in the display unit 30. In the display unit 30, the sub-pixels 11 adjacent to each other in the row direction (horizontal direction) are connected to one data line DTL. Thus, since the number of data lines DTL can be reduced in the display device 2, the circuit size of the data line driving unit 45 (to be described below) of the driving unit 40 can be reduced, thereby narrowing the frame region. In the display unit 10, one of the sub-pixels 11 adjacent to each other in the row direction is connected to the scanning line WSL1 and the other is connected to the scanning line WSL2. In the display unit 30, one of the sub-pixels 11 adjacent to each other in the column direction (vertical direction) is connected to the scanning line WSL1 and the other is connected to the scanning line WSL2.

The driving unit 40 includes a scanning line driving unit 43 and a data line driving unit 45. The scanning line driving unit 43 sequentially selects the sub-pixels 11 for each row by sequentially applying a scanning signal WS1 to the plurality of scanning lines WSL1 and sequentially applying a scanning signal WS2 to the plurality of scanning lines WSL2 according to control signals supplied from the timing generation unit 22. The scanning line driving unit 43 has the same configuration as the scanning line driving unit 23 (see FIG. 4) according to the above-described first embodiment. The data line driving unit 45 drives the data lines DTL of the display unit 30.

Figure 27:
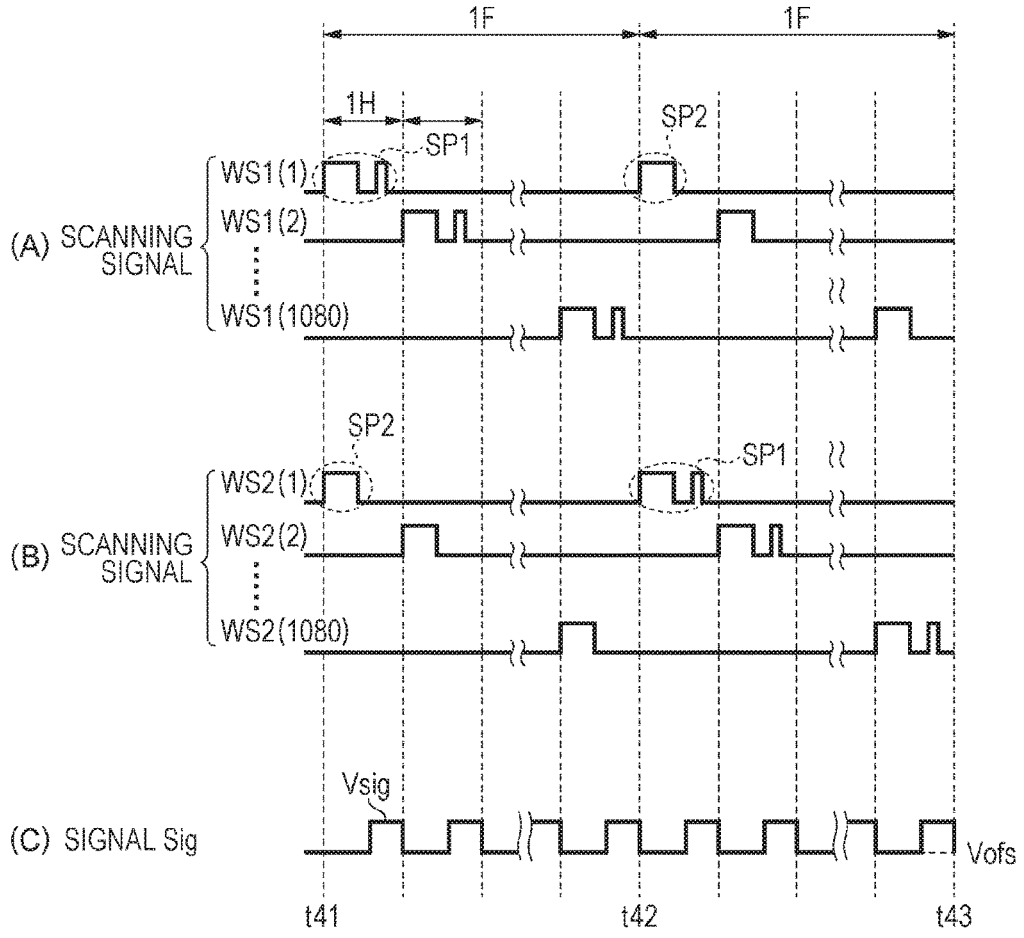
FIG. 27 is a timing waveform diagram illustrating one operation example of the display device illustrated in FIG. 25.

FIG. 27 is a diagram illustrating one operation example of the display device 2. FIG. 27(A) illustrates the waveform of the scanning signal WS1, FIG. 27(B) illustrates the waveform of the scanning signal WS2, and FIG. 27(C) illustrates the waveform of the signal Sig. In the drawings, a vertical blanking period is not illustrated to facilitate the description.

The display device 2 performs a display operation based on an odd frame image F(2n−1) during a period (one frame period (1F)) of timings t41 and t42 and performs a display operation based on an even frame image F(2n) subsequent to the frame image F(2n−1) during a period (one frame period (1F)) of subsequent timings t42 and t43.

Specifically, during the period of the timings t41 and t42, the scanning line driving unit 43 sequentially supplies the pulse SP1 to each scanning line WSL1 (see FIG. 27(A)) and sequentially supplies the pulse SP2 to each scanning line WSL2 (see FIG. 27(B)) for each horizontal period (1H). Then, the data line driving unit 45 supplies the pixel voltage Vsig based on the frame image F(2n−1) to the data line DTL in synchronization with the pulse SP1 in the scanning signal WS1 (see FIG. 27(C)).

Next, during the period of the timings t42 and t43, the scanning line driving unit 43 sequentially supplies the pulse SP2 to each scanning line WSL1 (see FIG. 27(A)) and sequentially supplies the pulse SP1 to each scanning line WSL2 (see FIG. 27(B)) for each horizontal period (1H). Then, the data line driving unit 45 supplies the pixel voltage Vsig based on the frame image F(2n) to the data line DTL in synchronization with the pulse SP1 in the scanning signal WS2 (see FIG. 27(C)).

In the sub-pixel 11 supplied with the pulse SP1, the initialization, the Vth correction, the μ correction, and the writing of the pixel voltage Vsig are performed as illustrated in FIG. 7. On the other hand, in the sub-pixel 11 supplied with the pulse SP2, the initialization and the Vth correction are performed among the initialization, the Vth correction, the μ correction, and the writing of the pixel voltage Vsig, but the writing of the pixel voltage Vsig is not performed. That is, in the sub-pixel 11 supplied with the pulse SP2, the voltage Vgs between the gate and the source of the driving transistor DRTr is set to be substantially the same as the threshold voltage Vth (Vgs=Vth) of the driving transistor DRTr. Thus, the sub-pixel 11 displays black.

Thus, the sub-pixel 11 connected to the scanning line WSL1 performs display based on the frame image F(2n−1) during the period of the timings t41 and t42 and the sub-pixel 11 connected to the scanning line WSL2 performs display based on the frame image F(2n) during the period of the timings t42 and t43.

Thereafter, the display device 2 repeatedly performs the operation during the period of the timings t41 to t43.

Figure 28A:
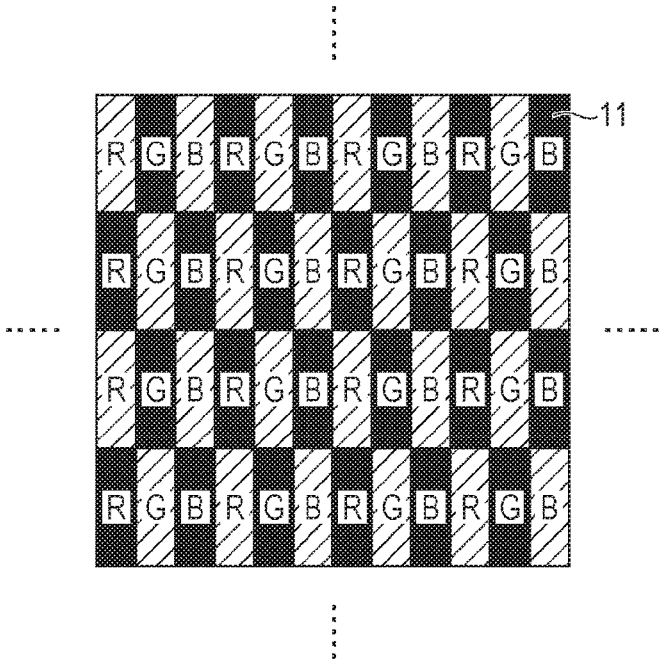
FIG. 28A is a diagram illustrating one operation example of the display unit illustrated in FIG. 25.
Figure 28B:
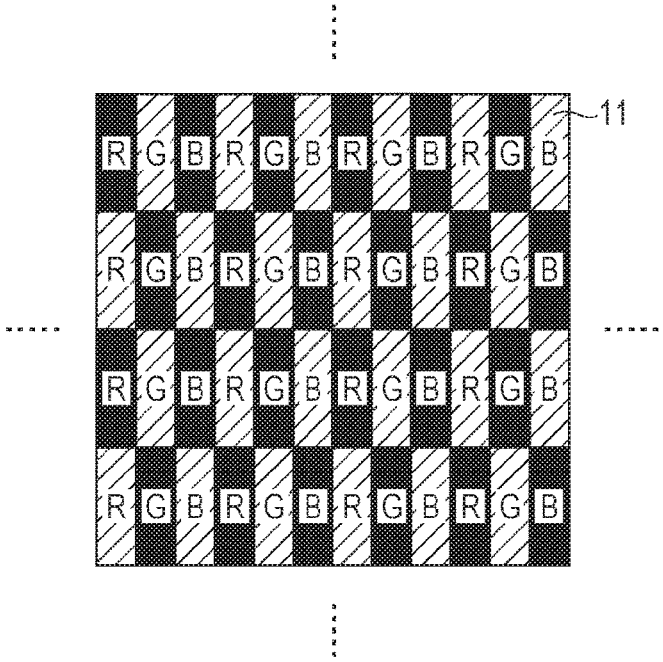
FIG. 28B is a diagram illustrating another operation example of the display unit illustrated in FIG. 25.

FIG. 28A is a diagram illustrating an operation of each sub-pixel 11 when displaying the frame image F(2n−1). FIG. 28B is a diagram illustrating an operation of each sub-pixel 11 when displaying the frame image F(2n). In FIGS. 28A and 28B, the sub-pixels 11 indicated by hatching are the sub-pixels 11 that perform display according to the pixel voltage Vsig. On the other hand, the sub-pixels 11 indicated by black are the sub-pixels 11 that perform the black display. In the display device 2, as illustrated in FIGS. 28A and 28B, the sub-pixels 11 perform display according to the pixel voltage Vsig in a checkerboard pattern shape during each frame period and the other sub-pixels 11 performs the black display. Each sub-pixel 11 switches between the display according to the pixel voltage Vsig and the black display for each frame period. Thus, an observer can observe display performed using all of the sub-pixels 11 of the display unit 30 by observing the display image for two frame periods.

In this embodiment, as described above, two pixels adjacent to each other in the row direction are connected to one data line. Therefore, the frame region can be narrowed. The other advantages are the same as those of the above-described first embodiment.

Modification Example 2-1

In the above-described embodiment, the sub-pixels 11 that do not write the pixel voltage Vsig perform the black display, but the present disclosure is not limited thereto. Instead, for example, the sub-pixels 11 may continue the display without change based on the pixel voltage Vsig relevant to the immediately previous frame image F. A modification example of the embodiment will be described in detail below.

Figure 29:
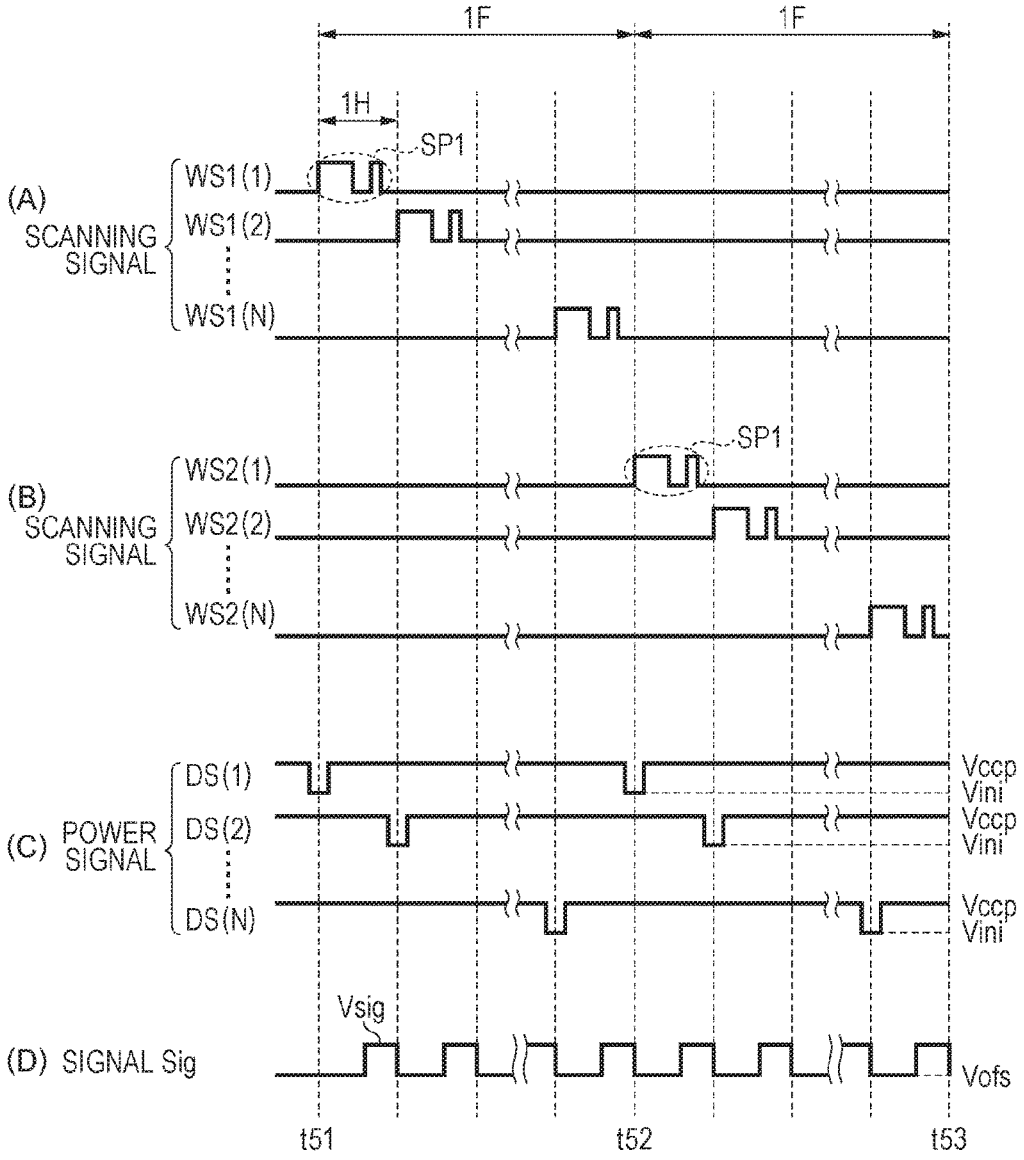
FIG. 29 is a timing waveform diagram illustrating one operation example of a display device according to a modification example of the second embodiment.

FIG. 29 is a diagram illustrating one operation example of a display device 2A according to this modification example. FIG. 29(A) illustrates the waveforms of N scanning signals WS1, FIG. 29(B) illustrates the waveforms of N scanning signals WS2, and FIG. 29(C) illustrates the waveform of the signal Sig.

First, during a period of timings t51 and t52, a scanning line driving unit 43A of the display device 2A sequentially supplies the pulse SP1 to each scanning line WSL1 for each horizontal period (1H) (see FIG. 29(A)). At this time, unlike the above-described embodiment (see FIG. 27(B)), a scanning line driving unit 43A does not supply the pulse SP2 to each scanning line WSL2. During a period of timings t42 and t43, the scanning line driving unit 43A sequentially supplies the pulse SP1 to each scanning line WSL2 for each horizontal period (1H) (see FIG. 29(B)). At this time, the scanning line driving unit 43A does not supply the pulse SP2 to each scanning line WSL1, unlike the case of the above-described embodiment (see FIG. 27(A)).

Figure 30A:
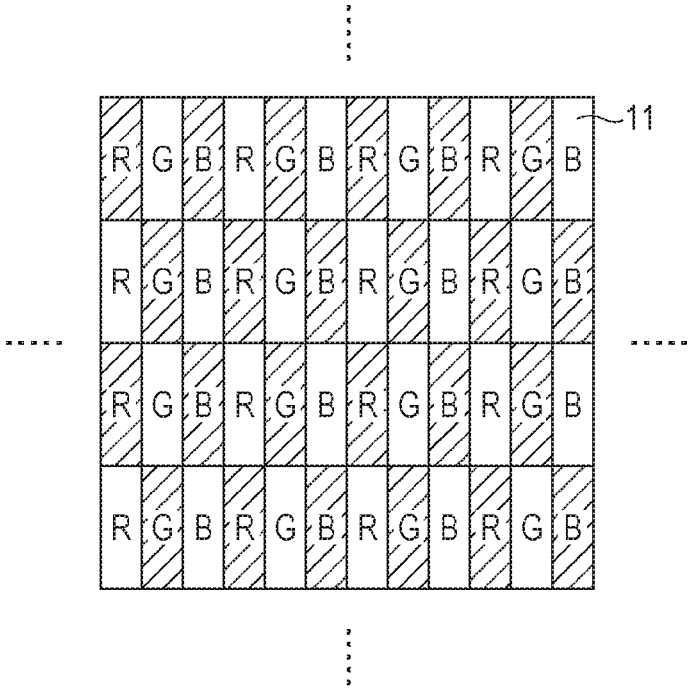
FIG. 30A is a diagram illustrating one operation example of a display unit illustrated in FIG. 29.
Figure 30B:
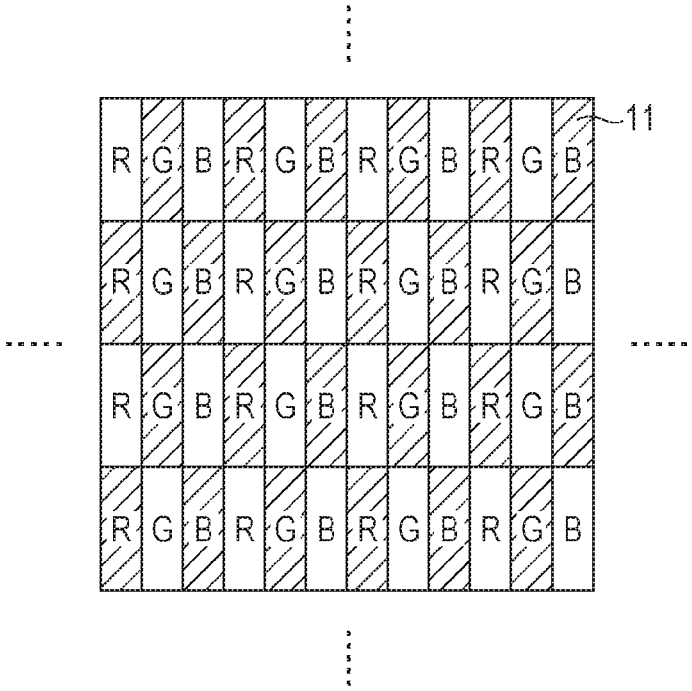
FIG. 30B is a diagram illustrating another operation example of the display unit illustrated in FIG. 29.

FIG. 30A is a diagram illustrating an operation of each sub-pixel 11 when the frame image F(2n−1) is displayed. FIG. 30B is a diagram illustrating an operation of each sub-pixel 11 when the frame image F(2n) is displayed. In FIGS. 30A and 30B, the sub-pixels 11 indicated by hatching are the sub-pixels 11 that perform display according to the pixel voltage Vsig. On the other hand, the sub-pixels 11 not indicated by the hatching are the sub-pixels that are not driven during each frame period and display the immediately previous frame image F.

Even this configuration can be applied to a use case in which an influence on image quality is not very large, for example, a use case in which a still image is displayed or a use case in which a moving image with images not changed rapidly is displayed.

Modification Example 2-2

The above-described modification examples 1-1 to 1-5 of the first embodiment may be applied to the display device 2 according to the above-described embodiment.

3. Application Examples

Next, an application example of the display device described in the embodiments and the modification examples will be described.

Figure 31:
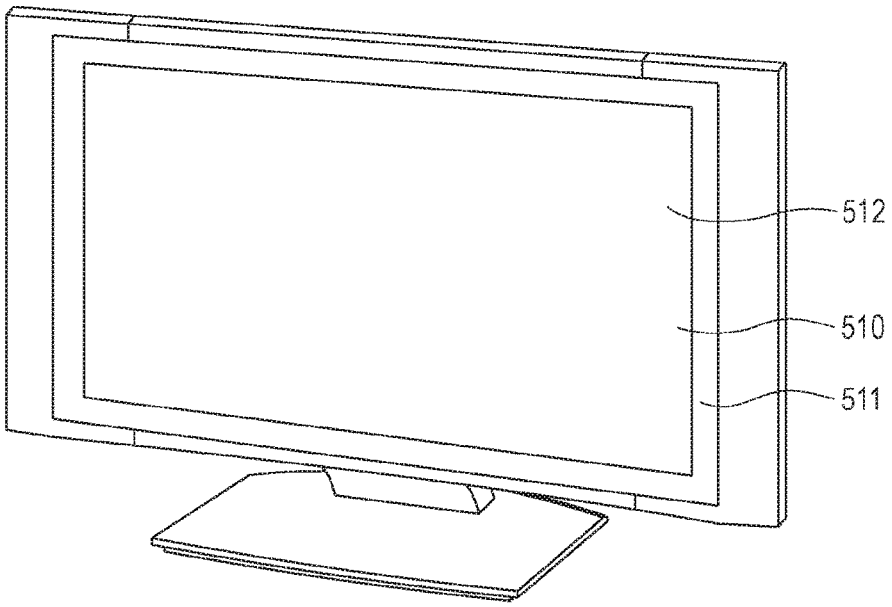
FIG. 31 is a perspective view illustrating the outer appearance configuration of a television apparatus to which the display device according to the embodiments is applied.

FIG. 31 is a diagram illustrating the outer appearance of a television apparatus to which the display device of the above-described embodiments and the like is applied. The television apparatus includes a video display screen unit 510 including a front panel 511 and a filter glass 512. The television apparatus includes the display device according to the above-described embodiments and the like.

The display device according to the above-described embodiments and the like can be applied not only to the television apparatus but also electronic apparatuses of all kinds of fields, such as a digital camera, a notebook-type personal computer, a portable terminal apparatus such as a portable telephone, a portable game apparatus, and a video camera. In other words, the display device according to the above-described embodiments and the like can be applied to electronic apparatuses of all kinds of fields for display of a video.

The present disclosure has been described according to the several embodiments and modification examples and the application example of an electronic apparatus, but the present disclosure is not limited to these embodiments and various modifications can be made.

For example, in each of the above-described embodiments, the display device includes the organic EL display elements, but the present disclosure is not limited thereto. Any display device may be used, as long as the display device includes current driving type display elements.

Embodiments of the present disclosure can be configured to include follows.

(1) A display device comprising: a display unit having a plurality of pixel circuits; and a scanning line driving unit configured to drive the display unit through a plurality of scanning lines, the scanning line driving unit comprising a signal generation unit configured to provide a plurality of pulse signals and a plurality of first selection signals, wherein a number of the plurality of first selection signals corresponds to a first set of the plurality of scanning lines configured to receive the plurality of first selection signals sequentially and to receive a first one of the plurality of pulse signals.

(2) The display device according to (1), wherein the number of the plurality of first selection signals multiplied by a number of the plurality of pulse signals equals a number of the plurality of scanning lines.

(3) The display device according to (1) or (2), wherein the number of the plurality of first selection signals is larger than a number of the plurality of pulse signals.

(4) The display device according to any one of (1) to (3), wherein the scanning line driving unit further comprises a plurality of first transistors connected to the plurality of scanning lines, and a control terminal of a first one of the plurality of first transistors is configured to receive one of the plurality of first selection signals.

(5) The display device according to any one of (1) to (4), wherein the scanning line driving unit further comprises a plurality of second selection signals.

(6) The display device according to any one of (1) to (5), wherein the number of the plurality of first selection signals multiplied by a number of the plurality of second selection signals and by a number of the plurality of pulse signals equals a number of the plurality of scanning lines.

(7) The display device according to any one of (1) to (6), wherein the scanning line driving unit further includes a plurality of first transistors and a plurality of second transistors, and a first one of the plurality of first transistors and a first one of the plurality of second transistors are connected in series and connected to a first one of the plurality of scanning lines.

(8) The display device according to any one of (1) to (7), wherein a control terminal of the first one of the plurality of first transistors is configured to receive one of the plurality of first selection signals, and a control terminal of the first one of the plurality of second transistors is configured to receive one of the plurality of second selection signals.

(9) The display device according to any one of (1) to (8), further comprising a power line driving unit configured to drive the display unit through a plurality of power lines.

(10) The display device according to any one of (1) to (9), wherein the power line driving unit includes a power signal generation unit configured to provide a first power signal and a second power signal.

(11) The display device according to any one of (1) to (10), wherein the first power signal is supplied to odd numbers of the plurality of power lines and the second power signal is supplied to even numbers of the plurality of power lines.

(12) The display device according to any one of (1) to (11), wherein a sum of the odd numbers and the even numbers of the plurality of power lines is the same as the number of the plurality of scanning lines.

(13) The display device according to any one of (1) to (12), wherein the first power signal and the second power signal provide one of a first voltage and a second voltage.

(14) The display device according to any one of (1) to (13), wherein the first power signal provides the second voltage from a start time of a threshold correction period through at least a portion of a light emission period.

(15) The display device according to any one of (1) to (14), wherein at least one of the plurality of pixel circuits includes an organic electroluminescent element.

(16) An electronic apparatus comprising the display device according to any one of (1) to (15).

(17) A display device comprising:

a display unit having a plurality of pixel circuits; a scanning line driving unit configured to drive the display unit through a plurality of scanning lines; and a power switching unit configured to drive the display unit through a plurality of power lines, the power line driving unit including a power signal generation unit configured to provide a first power signal and a second power signal, wherein the first power signal and the second power signal provide one of a first voltage and a second voltage; and wherein the first power signal is supplied to odd numbers of the plurality of power lines and the second power signal is supplied to even numbers of the plurality of power lines.

(18) The display device according to (17), wherein the scanning line driving unit comprises a signal generation unit configured to provide a plurality of pulse signals and a plurality of selection signals, wherein a number of the plurality of selection signals corresponds to a first set of the plurality of scanning lines configured to receive the plurality of selection signals sequentially and to receive a first one of the plurality of pulse signals.

(19) The display device according to (17) or (18), wherein the number of the plurality of selection signals multiplied by a number of the plurality of pulse signals equals a number of the plurality of scanning lines.

(20) The display device according to any one of (17) to (19), wherein the number of the plurality of selection signals corresponds to a second set of the plurality of scanning lines configured to receive the plurality of selection signals sequentially and to receive a second one of the plurality of pulse signals.

(21) A display device includes: a display unit that includes a plurality of pixels and a plurality of scanning signal lines delivering scanning pulses to the plurality of pixels; and a scanning unit that includes a first switch provided in association with each of the plurality of scanning signal lines and selectively extracting the scanning pulse from one of a plurality of scanning pulse signals including the plurality of scanning pulses.

(22) In the display device described in (21), the plurality of first switches may be divided into M switch groups each including N first switches. The M scanning pulse signals may be supplied to each of the M switch groups.

(23) In the display device described in (22), the N first switches of each switch group may be subjected to ON and OFF control according to N first selection signals, respectively.

(24) The display device described in (22) further includes second switches that are interposed between the first switches and the scanning signal lines associated with the first switches. The N first switches of each switch group may be divided into L sub-switch groups each including K first switches. The first switches belonging to the L sub-switch group may be subjected to ON and OFF control according to the L first selection signal, respectively. The K second switches connected to the K first switches belonging to each sub-switch group may be subjected to ON and OFF control according to the K second selection signals.

(25) In the display device described in any one of (21) to (24), the display unit may further include a plurality of power lines that supply power to the plurality of pixels. The plurality of power lines may be divided into a plurality of power groups and the power lines belonging to the same power group may be connected to each other.

(26) In the display device described in (25), the plurality of power lines may be divided into two power groups. The power lines belonging to the respective power groups may be alternately disposed one by one in an arrangement direction of the power lines.

(27) In the display device described in (25), the power lines belonging to the respective power groups may be arranged so as to be circular between the power groups by each predetermined number in an arrangement direction of the power lines.

(28) The display device described in any one of (25) to (27) may further include a power supply unit that applies, to the power lines belonging to each power group, power signals that transition between a first voltage used to turn off the pixels and a second voltage used to turn on the pixels and are different from each other between the power groups.

(29) In the display device described in (28), the power supply unit may be configured to be able to adjust a time ratio of a time of the first voltage to a time of the second voltage in each power signal for each power group.

(30) In the display device described in (28) or (29), the display unit may be subjected to write driving by line sequential scanning. The power supply unit may supply the first voltage to the power lines belonging to the same group as the group of the power lines connected to write target pixels.

(31) In the display device described in any one of (28) to (30), the power signal may be a signal transitioning from the second voltage to the first voltage in a plurality of steps.

(32) In the display device described in any one of (28) to (31), the power signal may be a signal transitioning from the first voltage to the second voltage in a plurality of steps.

(33) In the display device described in (31) or (32), the power signal may be a signal transitioning in two steps via a third voltage.

(34) In the display device described in (33), the third voltage may be a grounding level.

(35) In the display device described in (33) or (34), the power supply unit may include a first driving circuit that generates a first driving signal transitioning between the first and third voltages, a second driving circuit that generates a second driving signal transitioning between the second and third voltages, and a selection circuit that generates the power signal by selecting at least one of the first and second driving signals.

(36) In the display device described in any one of (21) to (35), the pixel may include a display element, a first transistor that includes a gate, a drain supplied with a power voltage, and a source connected to the display element, a capacitative element that is interposed between the gate and the source of the first transistor, and a second transistor that supplies a pixel voltage to the gate of the first transistor, when the second transistor enters an ON state.

(37) In the display device described in (36), the pixel may further include a third transistor that supplies a power voltage to the drain of the first transistor, when the third transistor enters an ON state.

(38) A driving circuit includes a first switch that is provided in association with each of a plurality of scanning signal lines delivering scanning pulses to a plurality of pixels and selectively extracts the scanning pulse from one of a plurality of scanning pulse signals including the plurality of scanning pulses.

(39) An electronic apparatus includes: a display device; and a control unit that performs operation control on the display device. The display device includes a display unit that includes a plurality of pixels and a plurality of scanning signal lines delivering scanning pulses to the plurality of pixels, and a scanning unit that includes a first switch provided in association with each of the plurality of scanning signal lines and selectively extracting the scanning pulse from one of a plurality of scanning pulse signals including the plurality of scanning pulses.

The present disclosure contains subject matter related to that disclosed in Japanese Priority Patent Application JP 2012-170489 filed in the Japan Patent Office on Jul. 31, 2012, the entire contents of which are hereby incorporated by reference.

It should be understood by those skilled in the art that various modifications, combinations, sub-combinations and alterations may occur depending on design requirements and other factors insofar as they are within the scope of the appended claims or the equivalents thereof.

What is claimed is:

1. A display device comprising:

a pulse signal line electrically connected to a source of a first transistor and a source of a second transistor;

a first switch between the pulse signal line and the source of the first transistor;

a first selection signal line electrically connected directly to a gate of the first transistor;

a second selection signal line electrically connected directly to a gate of the second transistor;

a third selection signal line electrically connected directly to a gate of the first switch and a gate of a second switch;

a first scanning signal line electrically connected directly to a drain of the first transistor; and a second scanning signal line electrically connected directly to a drain of the second transistor, wherein the second scanning signal line is between the first scanning signal line and a third scanning signal line, the third scanning signal line is between the second scanning signal line and a fourth scanning signal line, wherein the second switch is between the pulse signal line and the source of the second transistor.

2. The display device according to claim 1, wherein the third scanning signal line and the fourth scanning signal line extend along a direction.

3. The display device according to claim 2, wherein the first scanning signal line and the second scanning signal line extend along a direction.

4. The display device according to claim 1, wherein the first switch is controllable to electrically disconnect the pulse signal line from the source of the first transistor.

5. The display device according to claim 4, wherein the first switch is controllable to electrically connect the pulse signal line directly to the source of the first transistor.

6. The display device according to claim 1, further comprising:

a gate electrode of a write transistor electrically connected to the first scanning signal line.

7. The display device according to claim 6, wherein the write transistor is controllable by a signal on the first scanning signal line to electrically disconnect a driving transistor from a data line and electrically connect the data line to the driving transistor.

8. The display device according to claim 7, wherein the driving transistor is controllable to electrically disconnect a first power line from a light emitting element.

9. The display device according to claim 8, wherein the driving transistor is controllable to electrically connect the first power line to the light emitting element.

10. The display device according to claim 8, further comprising:

a first power signal line electrically connected to the first power line and a third power line.

11. The display device according to claim 10, further comprising:

a second power line between the first power line and the third power line.

12. The display device according to claim 11, further comprising:

a power signal generation unit configured to output a power signal onto the first power line while simultaneously outputting a second power signal onto the second power line.

13. The display device according to claim 11, further comprising:

a second power signal line that is electrically connected to the second power line and a fourth power line.

14. The display device according to claim 13, wherein the third power line is between the second power line and the fourth power line.

15. The display device according to claim 1, further comprising:

a signal generation unit configured to output a first selection signal onto the first selection signal line while simultaneously outputting a second selection signal onto the second selection signal line.

16. An electronic apparatus comprising:

The display device according to claim 1.

17. A display device comprising:

a pulse signal line electrically connected to a source of a first transistor and a source of a second transistor;

a first switch between the pulse signal line and the source of the first transistor;

a first selection signal line electrically connected directly to a gate of the first transistor;

a second selection signal line electrically connected directly to a gate of the second transistor;

a third selection signal line electrically connected directly to a gate of the first switch and a gate of a second switch;

a first scanning signal line electrically connected directly to a drain of the first transistor; and a second scanning signal line electrically connected directly to a drain of the second transistor, wherein the second scanning signal line is between the first scanning signal line and a third scanning signal line, the third scanning signal line is between the second scanning signal line and a fourth scanning signal line, wherein the second switch is controllable to electrically disconnect the pulse signal line from the source of the second transistor.

18. A display device comprising:

a pulse signal line electrically connected to a source of a first transistor and a source of a second transistor;

a first switch between the pulse signal line and the source of the first transistor;

a first selection signal line electrically connected directly to a gate of the first transistor;

a second selection signal line electrically connected directly to a gate of the second transistor;

a third selection signal line electrically connected directly to a gate of the first switch and a gate of a second switch;

a first scanning signal line electrically connected directly to a drain of the first transistor; and a second scanning signal line electrically connected directly to a drain of the second transistor, wherein the second scanning signal line is between the first scanning signal line and a third scanning signal line, the third scanning signal line is between the second scanning signal line and a fourth scanning signal line, wherein the second switch is controllable to electrically connect the pulse signal line directly to the source of the second transistor.

* * * * *